US005766830A

United States Patent [19]

Shimizu et al.

[11] Patent Number: 5,766,830

[45] Date of Patent: Jun. 16, 1998

[54] PHOTOGRAPHIC PROCESSING METHOD FOR PROCESSING A SILVER HALIDE PHOTOGRAPHIC LIGHT-SENSITIVE MATERIAL

[75] Inventors: Akira Shimizu; Shoji Nishio; Yasunori Wada; Iku Metoki, all of Hino, Japan

[73] Assignee: Konica Corporation, Tokyo, Japan

[21] Appl. No.: 806,647

[22] Filed: Feb. 26, 1997

Related U.S. Application Data

[63] Continuation of Ser. No. 523,388, Sep. 5, 1995, abandoned.

[30] Foreign Application Priority Data

Sep. 9, 1994 [JP] Japan ..... 6-216087
Sep. 13, 1994 [JP] Japan ..... 6-218951

[51] Int. Cl.[6] ..... G03C 3/00; G03C 5/18; G03C 5/26; G03C 11/00

[52] U.S. Cl. ..... 430/398; 430/399; 430/436; 430/440; 430/441; 430/463; 430/465

[58] Field of Search ..... 430/398, 399, 430/436, 440, 441, 463, 465

[56] References Cited

U.S. PATENT DOCUMENTS

| | | | |
|---|---|---|---|
| 2,482,546 | 9/1949 | Kaszuba | 95/88 |
| 2,596,926 | 5/1952 | Gunther et al. | 95/2 |

(List continued on next page.)

FOREIGN PATENT DOCUMENTS

| | | | |
|---|---|---|---|
| 0580372 | 1/1994 | European Pat. Off. | 430/465 |
| 0 589 460 A1 | 3/1994 | European Pat. Off. . | |
| 0 611 987 A1 | 8/1994 | European Pat. Off. . | |
| 1117386 | 11/1961 | Germany | 430/436 |
| 1919841 | 12/1969 | Germany | 430/441 |
| 62-279331 A | 12/1987 | Japan . | |
| 6-130572 | 5/1994 | Japan | 430/458 |
| 767700 | 2/1957 | United Kingdom | 430/465 |
| 93/11456 | 6/1993 | WIPO | 430/441 |

*Primary Examiner*—Glenn Caldarola
*Assistant Examiner*—J. Pasterczyk
*Attorney, Agent, or Firm*—Finnegan, Henderson, Farabow, Garrett & Dunner, L.L.P.

[57] ABSTRACT

A method for processing an exposed black and white silver halide photographic light-sensitive material includes the steps of: (1) developing the exposed light-sensitive material with a developing solution, (2) fixing the developed material with a fixing solution, (3) washing the fixed material with water which is replenished in an amount of from 0 to 3 liter/$m^2$ of the exposed light-sensitive material, and (4) drying the washed material. The developing solution is replenished with a solid photographic composition. This solid photographic composition includes a developing agent selected from the group of a dihydroxybenzene developing agent represented by Formula I and a developing agent represented by Formula II (provided that the developing agent represented by Formula II may form a sodium salt, a potassium salt or a lithium salt). Formulae I and II are as follows:

Formula I

Formula II

In the formulae, $R_1$, $R_2$, $R_3$, and $R_4$ each represents a hydrogen atom, an alkyl group, an aryl group, a carboxyl group, a halogen atom or a sulfo group; $R_7$ represents a hydrogen atom, an alkyl group, an aryl group, an amino group, an alkoxyl group, a sulfo group, a carboxyl group, an amido group or a sulfonamido group; $E^1$ represents an oxygen atom or a sulfur atom; and $E^2$ represents an oxygen atom, a sulfur atom or an $NR_8$ group, provided that $R^8$ represents an alkyl group or an aryl group.

11 Claims, 2 Drawing Sheets

U.S. PATENT DOCUMENTS

| | | | |
|---|---|---|---|
| 2,688,548 | 9/1954 | Reynolds | 430/465 |
| 2,688,549 | 9/1954 | James et al. | 430/465 |
| 3,128,182 | 4/1964 | Bard et al. | 96/61 |
| 3,128,183 | 4/1964 | Jones et al. | 96/107 |
| 3,253,919 | 5/1966 | Beavers et al. | 96/50 |
| 3,505,068 | 4/1970 | Beckett et al. | 96/68 |
| 3,532,501 | 10/1970 | Mackey et al. | 96/107 |
| 3,574,628 | 4/1971 | Jones | 96/107 |
| 3,582,346 | 6/1971 | Dersch | 96/109 |
| 3,655,394 | 4/1972 | Illingsworth | 96/108 |
| 3,658,527 | 4/1972 | Kunz et al. | 430/436 |
| 3,813,247 | 5/1974 | Minsk et al. | 96/68 |
| 4,230,796 | 10/1980 | Gunther et al. | 430/523 |
| 4,269,929 | 5/1981 | Nothnagle | 430/264 |
| 4,414,310 | 11/1983 | Daubendiek et al. | 430/567 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,444,877 | 4/1984 | Koitabashi et al. | 430/567 |
| 4,826,757 | 5/1989 | Yamada | 430/463 |
| 5,098,819 | 3/1992 | Knapp | 430/441 |
| 5,147,767 | 9/1992 | Knapp | 430/441 |
| 5,196,298 | 3/1993 | Meeus et al. | 430/440 |
| 5,236,816 | 8/1993 | Purol et al. | 430/441 |
| 5,264,323 | 11/1993 | Purol et al. | 430/441 |
| 5,266,442 | 11/1993 | Ooms | 430/436 |
| 5,278,035 | 1/1994 | Knapp | 430/441 |
| 5,351,103 | 9/1994 | Komatsu et al. | 430/398 |
| 5,376,510 | 12/1994 | Parker et al. | 430/440 |
| 5,460,926 | 10/1995 | Komatsu et al. | 430/465 |

PHOTOGRAPHIC PROCESSING METHOD FOR PROCESSING A SILVER HALIDE PHOTOGRAPHIC LIGHT-SENSITIVE MATERIAL

This application is a continuation of application Ser. No. 08/523,388, filed Sep. 5, 1995, now abandoned.

FIELD OF THE INVENTION

The present invention relates to a photographic processing method for a silver halide photographic light-sensitive material, more particularly to a photographic processing method for a silver halide photographic light-sensitive material wherein favorable water-washing properties and image storage stability are obtained even when an amount of washing water is extremely reduced.

BACKGROUND OF THE INVENTION

Conventionally, a photographic processing composition is generally classified into a liquid type one and a solid type one (a powder type and a granule type). In addition, in order to process a large amount of silver halide photographic light-sensitive materials (hereinafter, referred to as a light-sensitive material) with high fidelity, an automatic processing machine is used. In the case of the liquid type, a processing composition has only to be supplied to a processing tank. On the contrary, in the case of the solid type, the processing composition is supplied directly to the processing tank and subjected to stirring for a certain time or the processing composition dissolved in water in advance is supplied to the processing tank. Therefore, in terms of operability, the solid processing composition is inferior to the liquid processing composition. In addition, chemicals constituting the solid processing composition include some hazardous ones. Accordingly, when the solid processing composition is supplied to a processing tank, fine powder occurs, causing an environmental problems. On the other hand, since the liquid processing composition is dissolved in water, the liquid processing composition is heavy and bulky. In addition, when the liquid processing composition is supplied to the processing tank or a replenisher tank in the automatic processing machine, the liquid was sometimes spilled, contaminating a floor.

However, the solid processing composition can be remarkably reduced in terms of dimension and weight, compared to the liquid processing composition. Therefore, it is extremely advantageous in terms of transportation and storage. In addition, recently, demand for space saving has come from customers. In addition to the downsizing of the automatic processing machine and an apparatus for solution preparation and replenishment, space saving for the processing composition has been demanded. Therefore, solidification of a photographic processing composition has attracted public notice.

Demand for saving washing water used for automatic photographic processing has been enhanced from a viewpoint of resource saving and reduction of production cost. However, when the amount of washing water is reduced, poor desilvering property of the light-sensitive material occurs after photographic processing and sufficient water washing property and image storage stability could not be obtained.

In addition, in a conventional silver halide photographic light-sensitive material, in order to provide light-sensitivity to a desired spectral region, it is ordinary for a silver halide emulsion to be adsorbed a dye called a sensitizing dye. In order to prevent scattering of light in an emulsion layer in the course of exposure, a compound called a dye is added to an emulsion layer or a non-light-sensitive layer. Most of these sensitizing dyes and dyes dilute in a developing solution or is decomposed in a fixing solution. Accordingly, unexposed portion after being processed becomes almost colorless and transparent. However, due to necessity to enhance photographic performance, some of sensitizing dyes and dyes have poor solubility and poor decomposition property in fixing. Therefore, inconvenience called residual color wherein unexposed portions after being processed is colored. Thus, a processing method wherein no residual color occurs has been demanded.

Considering the above-mentioned problems, an object of the present invention is to provide a photographic processing method for a silver halide photographic light-sensitive material wherein desilvering property, developability and water washing property are excellent even when an amount of washing water is reduced.

SUMMARY OF THE INVENTION

The above-mentioned object of the present invention can be attained by the following constitution.

Item 1: A method for processing an exposed silver halide photographic light-sensitive material comprising the steps of:

(1) developing said exposed silver halide photographic light-sensitive material with a developing solution, (2) fixing the developed material with a fixing solution, (3) washing the fixed material with water which is replenished in an amount of from 0 to 3 liter/$m^2$ of said exposed silver halide photographic light-sensitive material, and (4) drying the washed material, wherein at least one of said developing solution and said fixing solution is replenished with a solid photographic composition, said solid photographic composition used for said developing solution comprises a developing agent selected from the group consisting of a dihydroxybenzene developing agent represented by Formula I and a developing agent represented by Formula II, provided that said developing agent represented by Formula II may form a sodium salt, a potassium salt or a lithium salt, and said solid photographic composition used for said fixing solution comprises a fixing agent:

Formula I

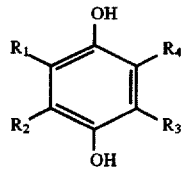

wherein $R_1$, $R_2$, $R_3$ and $R_4$ each represents a hydrogen atom, an alkyl group, an aryl group, a carboxyl group, a halogen atom or a sulfo group;

Formula II

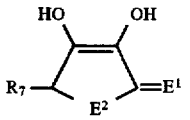

wherein $R_7$ represents a hydrogen atom, an alkyl group, an aryl group, an amino group, an alkoxyl group, a sulfo group, a carboxyl group, an amido group or a sulfonamido group; $E^1$ represents an oxygen atom or an sulfur atom; $E^2$ represents an oxygen atom, a sulfur atom or $NR_8$ group, provided that $R_8$ represents an alkyl group or an aryl group.

Item 2: The method of item 1, wherein said dehydroxybenzene developing agent by represented by Formula I is a hydroquinone.

Item 3: The method of item 1, wherein said developing agent by represented by Formula II is a compound selected from the group consisting of L-ascorbic acid, D-ascorbic acid, L-erythrobic acid, D-glucoascorbic acid, L-erythroascorbic acid, D-glucoascorbic acid, 6-deoxy-L-ascorbic acid, L-rhamnoascorbic acid, imino-6-deoxy-L-ascorbic acid, imino-D-glucoheptoascorbic acid, L-glycoascorbic acid, D-galactoascorbic acid, L-araboascorbic acid and sorboascorbic acid.

Item 4: The method of item 1, wherein said fixing agent is a thiosulfate compound selected from the group consisting of a sodium thiosulfate, a potassium thiosulfate and a lithium thiosulfate.

Item 5: The method of item 1, wherein said solid photographic composition used for said fixing solution comprises a buffer agent selected from the group consisting of a tartaric acid, a citric acid, a malic acid, a maleic acid, an itaconic acid, an adipic acid, a 3'-3-thiodipropionic acid, a propionic acid, a levulinic acid, a phthalic acid, a malonic acid, a glutaric acid, a lactic acid, a boric acid and a succinic acid.

Item 6: The method of item 1, wherein said solid photographic composition used for said fixing solution comprises a buffer agent selected from the group consisting of citric acid, itaconic acid, succinic acid and tartaric acid.

Item 7: The method of item 1, wherein said water is replenished in an amount of from 60 ml to 240 ml/m$^2$ of said exposed silver halide photographic light-sensitive material in the washing step.

Item 8: The method of item 1, wherein said solid photographic composition is a tablet having a bulk density of 1.0 to 2.5 g/cm$^3$.

Item 9: The method of item 1, wherein said solid photographic composition is a granule or a powder each having a bulk density of 0.40 to 0.95 g/cm$^3$.

A method for processing a silver halide photographic light-sensitive material comprising a support having thereon at least one light-sensitive silver halide emulsion layer, wherein a processing composition is a solid photographic composition composed of two or more kinds of compounds and water is employed in an amount of 3 l/m$^2$ or less, in a washing step.

EXPLANATION OF NUMERALS

Figure 1:
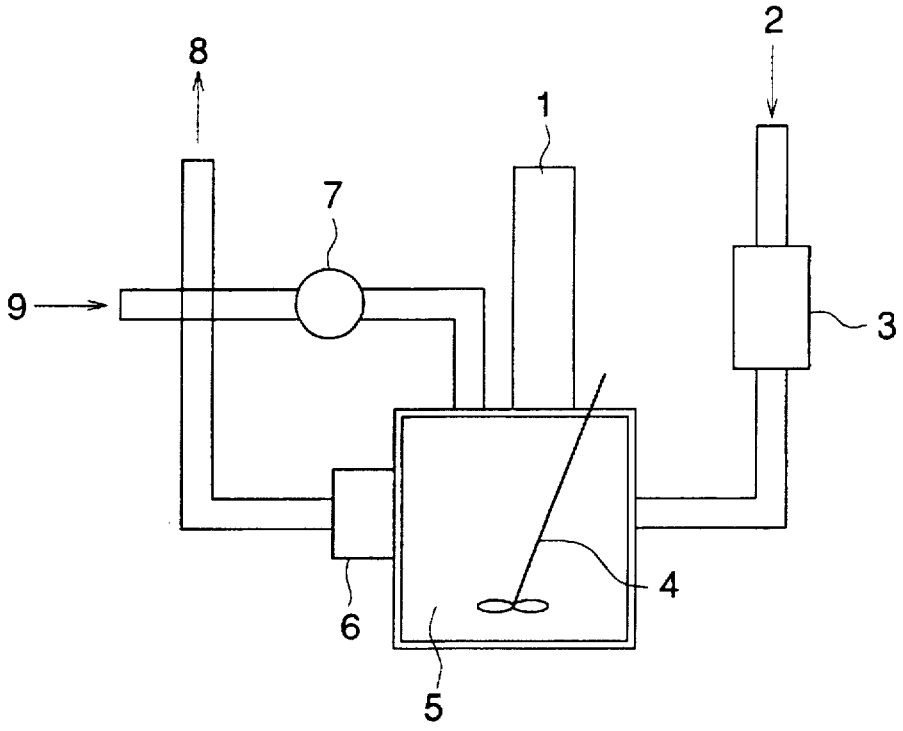
FIG. 1 is a schematic view of a dissolution portion of the fixing agent in an automatic processing machine of the present invention.

1. Tablet agent supplying device
2. Fixing solution sent from the fixing tank
3. Circulation pump
4. Stirring device
5. Dissolution tank for tablet agent
6. Filter
7. Electromagnetic valve
8. fixing solution sent to the fixing tank
9. Tap water
10. Developing tank
11. Waste liquor tank for developing
12. Fixing tank
13. Waste liquor tank for fixing
14, 15 and 16. Water washing
17. Water supply unit
18. Replenishing water tank
19. Drying zone
20. Dehumidifier

DETAILED DESCRIPTION OF THE INVENTION

Hereunder, the present invention will be explained in detail.

In the present invention, it was found that, even when a processing composition is a solid processing composition composed of two or more kinds of compound and an amount of washing water is reduced to 3 l/m$^2$ or less, desilvering property, water washing property and image storage stability are favorable. This was an unbelievable and surprising discovery which nobody had been aware of.

In the present invention, the amount of washing water can be reduced to 3 l/m$^2$ or less. However, depending upon the quality of water, there may be a case wherein bacteria generation occurs. Therefore, a water-dirt preventing apparatus as disclosed in Japanese Patent Publication Open to Public Inspection (hereinafter, referred to as Japanese Patent O.P.I. Publication) Nos. 63901/1991 and 333512/1993 may be used. In addition, a condition that the replenished amount of water is 3 l/m$^2$ or less may include so-called a water-stand system wherein the replenished amount of water is zero and also may include a stabilizer system having conventional various additives in this field as described in Japanese Patent O.P.I. Publication No. 64628/1990. In addition, in the present invention the replenished amount of water is preferably 60 ml/m$^2$ to 240 ml/m$^2$. When an overflowing solution flowes over into other processing tank in the washing step of the present invention, the overflowing solution may be recycled to use as a replenishing water or may be poured into other processing tank (for example, a fixing tank).

The solid processing composition of the present invention may be either of powder, granule, tablet or pill. Their mixture is also allowed. In addition, safe liquid composition such as water which cannot be hazardous may be used in combination for attaining the object of the present invention. For dividing and weighing, a tablet and a pill are especially preferable. In the case of a granule and a powder, it is preferable to pack individually with an alkali-soluble film, a plastic film or paper, after dividing and weighing.

Namely, a tablet and a pill can be supplied in a manner that they are divided and weighed so that they are accurate. With regard to powder and granule, the solid processing composition is completed by dividing, weighing and packaging individually.

The solid processing composition of the present invention includes the above-mentioned powder, tablet, pill and granule solid processing composition. They are subjected to humidity-proof processing if necessary. A paste type and a slurry type, which are semi-liquid type, are inferior in terms of storage stability. In addition, those which are subjected to regulation due to hazardousness in terms of transportation are excluded. These are not included in the solid processing composition of the present invention.

"Powder" defined in the present invention refers to gatherings of fine crystals. "Granule" defined in the present invention is powder subjected to granulating processing to be granular substance, and its particle size is 50 to 5000 μm. "Tablet" of the present invention represents powder or granules compressed and molded to a certain form.

In order to solidify a photographic processing composition, arbitrary means can be used; a condensed solution or fine powder or granular photographic processing composition is kneaded with water or an aqueous binding agent for molding, or a coated layer is formed by spraying an aqueous binding agent on the surface of a tentatively molded photographic processing composition (see Japanese Patent Application Nos. 135887/1990, 203165/1990, 203166/1990, 203167/1990, 203168/1990 and 300409/1990).

As a preferable production method of a tablet, a method that conducts a tableting process after granulating a powder solid processing composition is cited. This method has an advantage that solubility and storage stability have been improved compared to a solid processing composition wherein solid processing composition components are simply mixed for tableting and thereby photographic performances become stable.

As a granulating method for forming a tablet, various methods including a rotation granulation method, an extrusion granulation method, a compression granulation method, a crushing granulation method, a stirring granulation method, a fluidized bed granulation method and a spray-drying granulation method can be used. For forming a tablet, an average particle size of the resulting granule is preferably 100 to 800 μm, and more preferably 200 to 750 μm due to a point of view that unevenness of components, so-called segregation is difficult to occur when granules are mixed. In addition, with regard to particle size distribution, it is preferable that 60% or more of granule particles is included within deviation of ±100 to 150 μm. Next, in compressing the resulting granules, conventional compression machines such as a oil-pressure pressurer, a single-type tableting machine, a rotary tableting machine, and a pricketing machine can be used. The solid processing composition obtained through compression can take an arbitrary form. However, from productivity and handling property or from a dust problem in using at customers' side, a cylindrical type, the so-called a tablet is preferable.

In addition, in granulating, the above-mentioned effects becomes prominent by separating and granulating each component including an alkaline agent, a reducing agent and a preserving agent.

A tablet processing composition can be manufactured by ordinary methods described in Japanese Patent O.P.I. Publication Nos. 61837/1976, 155038/1979 and 88025/1077 and British Patent No. 1,213,808. A granule processing composition can be manufactured by ordinary methods described in Japanese Patent O.P.I. Publication Nos. 109042/1990, 109043/1990, 39735/1991 and 39739/1991. In addition, with regard to powder processing composition, arbitrary production methods described in Japanese Patent O.P.I. Publication No. 133332/1979, British Patent Nos. 725,892 and 729,862 and German Patent No. 3,733,861 can be used.

When the above-mentioned solid processing composition is a tablet agent, its bulk density is preferably 1.0 g/cm$^3$ to 2.5 g/cm$^3$ from the viewpoint of its solubility and the effects of the present invention. When the bulk density is larger than 1.0 g/cm$^3$, it is preferable in terms of the strength of a solid substance. In addition, when the bulk density is smaller than 2.5 g/cm$^3$, it is preferable in terms of solubility of the solid substance. When the solid processing composition is granule or powder, the bulk density is preferably 0.40 to 0.95 g/cm$^3$.

The solid processing composition of the present invention is used for photographic processing compositions including a developing agent, a fixer and a rinsing agent. Of these, the effects of the present invention, especially an effect to stabilize photographic performance appears in the developing agent and the fixing agent prominently.

In addition, the developing agent and the fixer are excepted from regulations about hazardous liquid.

From the viewpoint of the embodiment of the present invention, it is the most preferable that all processing compositions are solid processing compositions. However, it is preferable that, at least, the developing agent and the fixing agent are solid processing compositions. In other words, when components which cause chemical reaction mutually are contained in a large amount in a developing agent component and a fixing agent component and when hazardous components are also contained, the effects of the present invention appear most prominently. These have taken a form of a liquid separated-package kit heretofore so that hazardousness during transportation has been at a stake.

In the solid processing composition of the present invention, only one component of a certain processing agent may be solidified. Preferably, all components of aforesaid processing compositions are solidified. It is preferable that each component is molded as an individual solid processing composition and also packaged individually. In addition, it is also preferable that each component is packaged in an order of being dispensed repeatedly.

It is preferable to supply all processing compositions to be replenished to each processing tank in a form of solid processing compositions in accordance with information about processed amount. In addition, when replenishing water is necessary, replenishing water is replenished based on the information about processed amount or another information for controlling replenishing water. In this occasion, a liquid replenished to a processing tank may only be the replenishing water. In other words, when processing tanks in which replenishment is necessary are plural, the number of tank where liquid for replenishing is stored is saved to one by sharing the replenishing water so that downsizing of an automatic processing machine can be attained. Specifically, it is a preferable method, for downsizing the automatic processing machine, to place one replenishing water tank outside of the automatic processing machine.

When the developing agent is solidified, it is a preferable embodiment of solid processing agents used in the present invention that all of alkaline agents and reducing agents are solidified and that, in the case of a tablet, the number of the tablets is 3 or less and most preferably 1. When solidifying the processing agents by dividing into 2 or more, such tablet agents or granules are preferably in the same package.

In the present invention, as a means for supplying the solid processing composition to the processing tank, when the solid processing composition is a tablet agent, conventional methods such as those described in Japanese Utility Publication Open to Public Inspection Nos. 13783/1988, 97522/1988 and 85732/1989 can be used. In short, any methods can be used provided that a function to supply the tablet in the processing tank is provided at least. In addition, when the solid processing composition is granule or powder, a gravity-dropping method described in Japanese Utility Publication Open to Public Inspection Nos. 81964/1987 and 84151/1988 and Japanese Patent O.P.I. Publication No. 292375/1990 and methods employing screw or tap screw described in Japanese Utility Publication Nos. 105159/1988 and 195345/1988 are cited as conventional methods. However, the present invention is not limited thereto.

Any place is allowed for supplying the solid processing composition of the present invention provided that it is in the processing tank. The preferable is a place which is connected with a processing section which processes a light-sensitive material and where a processing solution circulates with aforesaid processing section. It is a preferable structure that there is constantly a certain circulation amount of processing solution with the processing section and that components dissolved move to the processing section. It is also preferable that the solid processing agent is supplied to a processing solution whose temperature is regulated.

The replenishing amount of the developing solution and the fixing solution are preferably 400 cc/m$^2$, and specifically preferably 200 cc/m$^2$ or less and 125 cc/m$^2$ or more for the developing solution, and 300 cc/m$^2$ or less and 200 cc/m$^2$ or more for the fixing solution.

The present invention is preferable for attaining objective drying property when an automatic processing machine with super rapid processing wherein a line speed is 1500 mm/min or more is used and developing, fixing, washing and/or stabilizing time are 20 to 60 seconds. In the case of the present invention, however, no deterioration of performance is caused even when a conventional automatic processing machines are used.

Next, a developing step, a fixing step, a washing step and a drying step in the present invention will be explained.

In the present invention, "development time" and "fixing time" are respectively a period of time from the moment when a light-sensitive material processed is immersed in a developing tank solution to the moment when it is immersed in a fixing solution and a time since it is immersed in a fixing tank solution until it is immersed in the next washing tank solution (stabilizer).

In addition, "a time for washing and/or stabilizing" is referred to as a time period for immersing it in washing tank solution and/or a stabilizing tank solution.

In the automatic processing machine, a drying zone where heated air of ordinarily 35° C. to 100° C. and preferably 40° C. to 80° C. is blown is provided. "Drying time" is a time wherein the light-sensitive material is placed in this drying zone.

Rapid processing of the present invention is referred to as the so-called Dry to Dry processing time for development, fixing washing and drying which is within 60 seconds and preferably within 50 second. "Ordinary processing" is pressing whose Dry to Dry processing time is longer than the above-mentioned one.

Here, "dry to dry" is referred to as a time from the moment when the leading edge of the light-sensitive material to be processed enter a film insertion port of the automatic processing machine to the moment when aforesaid leading edge comes out of the automatic processing machine after being processed. Incidentally, in the present invention, the premise of rapid processing is to use an automatic processing machine. With regard to ordinary processing, however, any method can be used.

In the case of conducting the above-mentioned rapid processing, it is preferable to use an automatic processing machine. For stable rapid processing, the line speed of the automatic processing machine is preferably 1000 mm/min or more and more preferably 1500 mm/min or more. However, owing to the constitution of the present invention, a compact automatic processing machine wherein the above-mentioned line speed cannot be obtained can obtain sufficient functions.

In the developer of the present invention, as a developing agent, a reductone a dihydroxybenzene developing agent represented by Formula I, an aminophenol and a pyrazolidone are preferably used. In addition, a compound represented by Formula II is preferably used.

The dihydroxybenzene developing agent represented by Formula I which may be used in the present invention, includes, for example, hydroquinone, chlorohydroquinone, bromohydroquinone, isopropylhydroquinone, isopropylhydroquinone, methylhydroquinone, 2,3-dichlorohydroquinone, 2,3-dibromohydroquinone, 2,5-dimethylhydroquinone, and among them, hydroquinone is especially preferably employed.

The pyrazolidone developing agent which may be used in the present invention, includes, for example, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone.

The aminophenol developing agents which may be used in the present invention, includes, for example, N-methyl-p-aminophenol, p-aminophenol, N-(β-hydroxyethyl)-p-aminophenol, 2-methyl-p-aminophenol, p-benzylaminophenol.

The typical examples relating to a developing agent represented by Formula II of the present invention will be given below. However, the invention shall not be limited thereto.

| | |
|---|---|
| II-1 | L-ascorbic acid |
| II-2 | D-ascorbic acid |
| II-3 | L-erythrobic acid |
| II-4 | D-glucoascorbic acid |
| II-5 | L-erythroascorbic acid |
| II-6 | D-glucoascorbic acid |
| II-7 | 6-deoxy-L-ascorbic acid |
| II-8 | L-rhamnoascorbic acid |
| II-9 | D-glucoheptoascorbic acid |
| II-10 | imino-6-deoxy-L-ascorbic acid |
| II-11 | imino-D-glucoheptoascorbic acid |
| II-12 | L-glucoascorbic acid |
| II-13 | D-galactoascorbic acid |
| II-14 | L-araboascorbic acid |
| II-15 | sorboascorbic acid |

| Compound No. | $E^1$ | $E^2$ | $R_3$ | $M_1$ | $M_2$ |
|---|---|---|---|---|---|
| II-16 | O | O | H | H | H |
| II-17 | O | O | $CH_3$ | H | H |
| II-18 | O | O | $CH_2$<br>\|<br>OH | H | H |
| II-19 | O | O | $CH_3CH-$<br>\|<br>OH | H | H |
| II-20 | O | O | $HOCH_2CH-$<br>\|<br>OH | H | H |
| II-21 | O | O | $HCH_2CH-$<br>\|<br>OH | Na | H |
| II-22 | O | O | $HOOCCH_2CH-$<br>\|<br>OH | H | Na |
| II-23 | S | O | H | Na | H |

-continued

| Compound No. | $E^1$ | $E^2$ | $R_3$ | $M_1$ | $M_2$ |
|---|---|---|---|---|---|
| II-24 | S | O | $CH_3CH(OH)-$ | H | H |
| II-25 | S | O | $HOCH_2CH(OH)-$ | H | H |
| II-26 | O | $NCH_3$ | H | H | H |
| II-27 | O | NH | $HOCH_2CH(OH)-$ | H | K |
| II-28 | O | S | H | H | H |
| II-29 | O | S | $HOCH_2CH(OH)-$ | H | H |
| II-30 | O | S | $CH_3CH(OH)-$ | H | H |
| II-31 | S | S | H | H | H |
| II-32 | S | S | $HOCH_2CH(OH)-$ | H | H |
| II-33 | S | S | H | H | H |

As a preserving agent, an organic reducing agent can be used in addition to sulfite described in Japanese Patent Application No. 286232/1992. In addition, a chelating agent described in Japanese Patent Application No. 586323/1992 (on page 20) and a bisulfite additive for a hardener described in the above-mentioned Application (on page 21) can be used. In addition, as a silver sludge preventing agent, it is preferable that compounds described in Japanese Patent Application Nos. 92947/1992 and 96118/1993 (Formula [4-a][4-b]) are added. In addition, it is preferable to add cyclodextrine compounds. Compounds described in Japanese Patent O.P.I. Publication are specifically preferable.

Amine compounds may be added to the developing agent of the present invention. Compounds described in U.S. Pat. No. 4,269,929 are especially preferably employed.

It is necessary to use a buffer agent for the developing agent used in the present invention. As the buffer agent, sodium carbonate, potassium carbonate, sodium bicarbonate, potassium bicarbonate, trisodium phosphate, tripotassium phosphate, dipotassium phosphate, sodium borate, potassium borate, sodium tetraborate (boric acid), potassium tetraborate, sodium o-hydroxybenzoic acid (sodium saltylic acid), sodium 5-sulfo-2-hydroxybenzoic acid (sodium 5-sulfosaltylic acid) and potassium 5-sulfo-2-hydroxybenzoic acid (potassium 5-sulfosaltylic acid).

As an development accelerator, thioether compounds disclosed in Japanese Patent Publication Nos. 16088/1962, 5987/1962, 12380/1969 and 9019/1970 and U.S. Pat. No. 3,813,247, p-phenylenediamine compounds disclosed in Japanese Patent O.P.I. Publication Nos. 49829/1977 and 15554/1975, quaternary ammonium salts disclosed in Japanese Patent O.P.I. No. 137726/1975, Japanese Patent Publication 30074/1969 and Japanese Patent O.P.I. Publication Nos. 156826/1981 and 43429/1977, p-aminophenols disclosed in U.S. Pat. Nos. 2,610,122 and 4,119,462, amine compounds disclosed in U.S. Pat. Nos. 2,494,903, 3,128,182, 4,230,796 and 3,253,919, Japanese Patent Publication No. 11431/1966 and U.S. Pat. Nos. 2,482,546, 2,596,926 and 3,582,346, polyalkyleneoxides disclosed in Japanese Patent Publication Nos. 16088/1962, 25201/1967, U.S. Pat. No. 3,128,183, Japanese Patent Publication Nos. 11431/1966 and 23883/1967 and U.S. Pat. No. 3,532,501, 1-phenyl-3-pyrazolidones, hydrazines, mesoion type compounds, ion type compounds and imidazoles can be added if necessary.

As an anti-foggant, alkaline metal halogenated substances such as potassium iodide organic anti-foggants can be used. As organic anti-foggants, for example, nitrogen-containing heterocycles including 1-phenyl-5-mercaptotetrazole such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazol, hydroxyazaindolizine and adenine are cited.

In addition, for a developing agent component used in the present invention, methylcelsolve, methanol, acetone, dimethylformamide and cyclodextrine compounds and compounds described in Japanese Patent Publication Nos. 33378/1972 and 9509/1969 can be used if necessary as an organic solvent for enhancing dissolvability of a developing agent.

In addition, various additives such as anti-stain agents, anti-sludge agents and multilayer effects accelerators can be used.

In addition, pH of the developing solution used in the present invention is preferably 9 to 13, and more preferably 10 to 12. As an alkaline agent used for regulating pH, sodium hydroxide, potassium hydroxide, sodium carbonate, potassium carbonate, sodium triphosphate and potassium triphosphate are cited.

In addition, buffer agents described in Japanese Patent O.P.I. Publication Nos. 28708/1986 (boric acid salt) and 93439/1985 (for example, succalose, acetooxium and 5-sulfosaltylic acid), phosphate and carbonate may be used.

As an additive used for those other than the above-mentioned components, any conventional ones can be used.

Development temperature and time are respectively 25° C. to 50° C. and preferably 30 seconds or less.

A processing solution having fixing ability used in the present invention is preferably an aqueous solution containing thiosulfate wherein pH is regulated to be 3.8 or more, preferably 4.2 to 6.8 and more preferably 4.7 to 5.5. As a fixing agent, thiosulfate is preferably used. In order to attain the object of the present invention, using an ammonium salt is not preferable. As a preferable fixing agent, sodium thiosulfate, potassium thiosulfate and lithium thiosulfate are cited. Considering fixing speed and influence on environment, sodium thiosulfate is more preferable. The amount of using the fixing agent can be changed appropriately. Ordinarily, it is 0.1 to 6 mol/liter and preferably 0.8 to 2 mol/liter.

To a fixing solution, a buffer agent may be added in order to inhibit an increase of pH due to carry-in from the developing solution. In order to attain the object of the present invention, using acetic acid is not preferable. As a preferable pH buffer agent, a tartaric acid, a citric acid, a malic acid, a maleic acid, an itaconic acid, an adipic acid, a 3'-3-thiodipropionic acid, propionic acid, levulinic acid, phthalic acid, malonic acid, glutaric acid, lactic acid, boric acid and succinic acid are cited. Among of them, citric acid, itaconic acid, succinic acid and tartaric acid are more preferably used. To the fixing solution, a preserving agent may be added if necessary. As a preferable preserving agent, sodium sulfite, acidic sodium sulfite and potassium sulfite are cited. In addition, a chelating agent having an ability to soften hard water can be obtained.

It is also preferable to add a starter prior to processing. It is also preferable to solidify the starter for adding. As a starter, in addition to organic acids such as polycarboxylic acid compounds, halogenated substances of alkaline earth metal such as KBr, organic inhibitors and development accelerators can be used.

These compounds are effective when containing 0.005 mol or more per 1 l of fixing solution, and 0.01 mol/l to 0.03 mol/l is more preferable.

To a fixing agent, if necessary, preservers (for example, sulfite and bisulfite), pH regulators (for example, sulfuric acid) and chelating agents having hard water softening ability can be used.

Fixing temperature and time are preferably about 20° C. to about 50° C. and 6 seconds to 1 minutes preferably, and more preferably 30° C. to 40° C. and 6 seconds to 30 seconds respectively.

With regard to the solid processing composition of the present invention, same effects are obtained in the case of liquid state immediately after a processing solution is adjusted and in the case of running state when the level of liquid in a processing tank has become constant.

There is no specific limitation to silver halide photographic light-sensitive materials used in the present invention. Those preferably used are mentioned below.

Emulsions used in the silver halide photographic light-sensitive material of the present invention can be manufactured by conventional methods. For example, 1•Emulsion Preparation and types described in Research Disclosure (RD) No. 17643 (December, 1978), on pp. 22 and 23 and a method described in (RD) No. 18716 (November, 1979), on page 648 are used. In addition, a method described in "The Theory of the Photographic Process" 4th edition, written by T. H. James, on pp. 38 through 104 published by Macmillan Inc. (1977) and methods described in "Chimie et physique photographique" written by P. Glafkid and published by Paul Montel (1967) and "Making and Coating Photographic Emulsion" written by V. L. Zelikman and other and published by Focal press Inc. (1964) can be used for preparation.

As a silver halide emulsion preferably used, an inner-high-iodide type mono-dispersed grains disclosed in Japanese Patent O.P.I. Publication Nos. 177535/1974, 802237/1986, 132943/1986 and 49751/1988 and Japanese Patent Application No. 238225/1988 are cited. The crystal habit may be of cubic, tetradecahedron, octahedron and arbitrary mixture of (111) plane and (100) plane which are interim of tetradecahedron and octahedron. The crystal structure of silver halide may be composed of silver halide composition wherein inside and outside are different. One of preferable embodiment of an emulsion is a core/shell type mono-dispersed emulsion having two-layer structure wherein the core portion is composed of high iodide and the shell portion is composed of low iodide. The silver iodide content in the high iodide portion is preferably 20 to 40 mol % and specifically preferably 20 to 30 mol %. The examples thereof include J. Phot. Sic. 12., on pp. 242 to 251, Japanese Patent O.P.I. Publication 36890/1973, 16364/1977, 142329/1980 and 49938/1983, British Patent No. 1,413,748, U.S. Pat. Nos. 3,574,628 and 3,655,394, British Patent No. 1,027,146, U.S. Pat. Nos. 3,505,068 and 4,444,877 and Japanese Patent O.P.I. Publication No. 14331/1985.

Another type of silver halide emulsion preferably used is a tabular grain whose average aspect ratio is larger than 1. The merits of the tabular grain include, as disclosed in British Patent No. 2,112,157, U.S. Pat. Nos. 4,439,520, 4,433,048, 4,414,310 and 4,434,226 and Japanese Patent O.P.I. Publication Nos. 113927/1983, 127921/1983, 138342/1988, 284272/1988 and 305343/1988, improvement in terms of spectral sensitization efficiency, graininess of images and sharpness. The emulsion can be prepared in accordance with the methods described in the above-mentioned patent applications.

Those described in Japanese Patent Application No. 289002/1992 (pp. 1 through 3), Japanese Patent O.P.I. Publication No. 177535/1984 (pp. 2 through 5), Japanese Patent Application No. 277369/1992 (pp. 5 and 6) and Japanese Patent O.P.I. Publication No. 42146/1987 (pp. 14 and 15) are specifically used preferably.

Another kind of preferable silver halide emulsion used in the present invention is silver bromochloride or silver chloride wherein silver chloride content is 50% or more.

The above-mentioned emulsions may be either of a surface latent image type wherein latent images are formed on the surface of grains, an inner latent image type forming latent images inside grains or a type wherein latent images are formed on the surface and inside thereof. To these emulsions, at a stage of physical ripening or grain preparation, cadmium salt, lead salt, zinc salt, thallium salt, iridium salt or its complex salts, rhodium salt or its complex salts and iron salt or its complex salts may be used. To the emulsion, in order to remove soluble salts, a washing method such as a noodle washing method and a flocculation precipitation method can be provided. Preferable washing methods include a method that uses an aromatic hydrocarbon type aldehyde resin containing a sulfo group described in Japanese Patent Publication No. 16086/1960 or a method that uses a coagulation polymer agent illustrated G3 and G8 described in Japanese Patent O.P.I. Publication No. 158644/1988 as a specifically preferable desalting method. As a chemical ripening method of an emulsion used in the light-sensitive material of the present invention, sensitization by means of gold sensitization, sulfur sensitization, reduction sensitization and charcogen and mixture thereof are preferably used.

To an emulsion of the light-sensitive material used in the present invention, during physical ripening or before or after chemical ripening, various photographic additives can be used. Hydrazine compounds may also be added. Of them, compounds described in Japanese Patent Application No. 134743/1993 are preferable. Specifically, compounds described in Formula (5) and Formulas (7) and (8) as nuclei-producing accelerators are preferable. In addition, tetrazolium salts can also be added. Those described in Japanese Patent O.P.I. Publication are specifically preferable. In addition, as conventional additives, compounds described in Research disclosure Nos. 17643 (December, 1978), 18716 (November, 1979) and 308119 (December, 1989) are cited. Kinds of compounds cited in these Research Disclosures and their description places were listed up as follows:

| | RD-17643 | | RD-18716 | | RD-308119 | |
|---|---|---|---|---|---|---|
| Additive | Page | Category | Page | Category | Page | Category |
| Chemical sensitizer | 23 | III | 648 upper right | | 996 | III |
| Sensitizing dye | 23 | IV | 648–649 | | 996–8 | IV |
| Desensitizing | 23 | IV | | | 998 | B |

-continued

| Additive | RD-17643 Page | RD-17643 Category | RD-18716 Page | RD-18716 Category | RD-308119 Page | RD-308119 Category |
|---|---|---|---|---|---|---|
| dye | | | | | | |
| Dye | 25–26 | VIII | 649–650 | | 1003 | VIII |
| Development accelerator | 29 | XXI | 648 upper right | | | |
| Anti-foggant, stabilizer | 24 | IV | 649 upper right | | 1006–7 | VI |
| Brightening agent | 24 | V | | | 998 | V |
| Hardener | 26 | X | 651 left | | 1004–5 | X |
| Surfactant | 26–7 | XI | 650 right | | 1005–6 | XI |
| Anti-static agent | 27 | XII | 650 right | | 1006–7 | XIII |
| Plasticizer | 27 | XII | 650 right | | 1006 | XII |
| Lubricant | 27 | XII | | | | |
| Matting agent | 28 | XVI | 650 right | | 1008–9 | XVI |
| Binder | 26 | XXII | | | 1003–4 | IX |
| Support | 28 | XVII | | | 1009 | XVII |

As supports usable in the light-sensitive materials of the present invention, those described in the above-mentioned RD-17643, on page 28 and RD-308119, on page 1009 are cited.

As a suitable support, a plastic film is used. On the surface thereof, in order to improve adhesivity of the coating layer, a subbing layer, corona discharge and UV ray irradiation may be provided. In addition, a crossover-cutting layer and an antistatic layer may be provided.

An emulsion layer may exist on both sides of the support, or may also exist on either side. In the case of both sides, both sides may have the same performance or may also have different performances.

EXAMPLE

Hereunder, examples of the present invention will be cited for explaining it in detail. However, the embodiment of the present invention is not limited thereto.

Example 1

(Preparation of silver halide emulsion A)

By the use of a double jet method, an emulsion wherein the content of silver chloride is 70 mol % and the remaining is silver bromide was prepared. At mixing concurrently, $K_3RhBr_6$ was added by $8.1\times10^{-8}$ mol per mol of silver. The resulting emulsion was a mono-dispersed cubic grain emulsion whose average grain size was 0.19 μm (the variation coefficient was 9%). Next, the emulsion was desalted with a compound G-8 in Japanese Patent O.P.I. Publication No. 280139/1990. EAg after being desalted was 190 mV at 50° C. Following this, the following [A], [B] and [C] were added by 50 mg/mol of silver in gelatin as an anti-mildew agent.

At temperature of 60° C., to the resulting emulsion, 100 mg of citric acid was added per mol of silver, 200 mg of sodium chloride was added per mol of silver and 12 mg of 1-phenyl-5-mercaptotetrazole was added per mol of silver. Following this, 10 mg of chloro aurate was added per mol of silver and 81.5 mg of Sulfur was added per mol of silver to the resulting mixture for chemical ripening. After reaching the maximum temperature, 1 g of 4-hydroxy-6-methyl-1,3,3a,7 tetrazaindene per mol of silver was added to the resulting mixture. After completing ripening, 600 mg of potassium bromide and 150 mg of a sensitizing dye SD-1 having the following structure were added.

(Preparation of silver halide photographic light-sensitive material)

On one side of a subbing layer of a polyethylene terephthalate film having a thickness of 100 μm and provided with antistatic processing as described in Example 1 of Japanese Patent O.P.I. Publication No. 92175/1991, a silver halide emulsion of the following formula 1 was coated in a manner to attain the amount of silver of 3.3 g/m$^2$.

In addition, on the upper layer, a coating solution of the following formula 2 was coated as a protective layer in a manner to attain the amount of gelatin of 1 g/m$^2$. In addition, on a subbing layer on the opposite side thereto, a backing layer of the following formula 3 was coated in a manner to attain the amount of gelatin of 2.7 g/m$^2$. In addition, on this layer, a protective layer of the following formula 4 was coated in a manner to attain the amount of gelatin of 1 g/m$^2$. Thus, a sample was prepared.

(Composition of a silver halide emulsion layer)

[A] [B] [C]

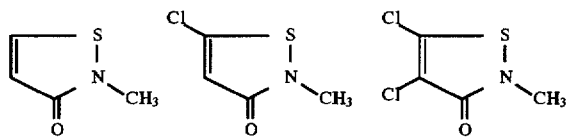

[A]:[B]:[C] = 46:50:4 (by mole ratio)

| | |
|---|---|
| Hydroquinone | 4 g/mol Ag |
| P-1 | 15 g/m$^2$ |
| ST-1 | 150 mg/mol Ag |
| Styrene-maleic acid copolymer | 2 g/mol Ag |
| S-1 | 1.5 g/mol Ag |
| SD-2 | 2.2 mg/mol Ag |
| SD-3 | 7.8 mg/mol Ag |
| 4-hydroxy-6-methyl-1,3,3a,7 tetrazaindene | 30 mg/mol Ag |
| Sodium salt of 2,4-dichloro-5-hydroxy-1,3,5-triazine | 10 mg/mol Ag |
| Adenine-1-phenyl-5-mercaptotetrazole | 5 mg/mol Ag |
| Saponin | 0.1 mg/mol Ag |
| S-2 | 8 mg/mol Ag |
| Na-9 | 500 mg/mol Ag |
| H-12 | $2\times10^{-3}$ mol/mol Ag |

-continued (Composition of emulsion protective layer)

| | |
|---|---|
| Gelatin | 1.1 g/m$^2$ |
| Formalin additive of sodium bisulfite | 1 mg/m$^2$ |
| 1-phenyl-4-hydroxymethyl-3-pyrazolidone | 5.5 mg/m$^2$ |
| Mono-dispersed silica (the average grain size is 3 μm) | 15 mg/m$^2$ |
| Mono-dispersed silica (the average grain size is 8 μm) | 15 mg/m$^2$ |
| S-2 | 12 mg/m$^2$ |
| Citric acid | 10 mg/m$^2$ |
| Formalin | 42 mg/m$^2$ |
| FA-33 | $3 \times 10^{-6}$ mol/m$^2$ |

(Composition of backing layer)

| | |
|---|---|
| Gelatin | 2.3 g/m$^2$ |
| Water-soluble dye-1 | 100 mg/m$^2$ |
| Water-soluble dye-2 | 25 mg/m$^2$ |
| Water-soluble dye-3 | 100 mg/m$^2$ |
| P-1 | 350 mg/m$^2$ |
| Styrene-maleic acid copolymer | 60 mg/m$^2$ |
| Colloidal silica | 150 mg/m$^2$ |
| Mixture of [A], [B] and [C] | 5 mg/m$^2$ |
| Sodium salt of dodecylbenzenesulfonic acid | 50 mg/m$^2$ |
| Glyoxal | 35 mg/m$^2$ |
| E-2 | 55 mg/m$^2$ |

(Composition of backing protective layer)

| | |
|---|---|
| Gelatin | 0.7 g/m$^2$ |
| S-2 | 7 mg/m$^2$ |
| Mono-dispersed polymethylmethacrylate matting agent (the average grain size is 5.5 μm) | 50 mg/m$^2$ |
| Mixture of [A], [B] and [C] | 2.5 mg/m$^2$ |
| Styrene-maleic acid copolymer | 40 mg/m$^2$ |
| Glyoxal | 5 mg/m$^2$ |
| Sodium salt of 2.4-dichloro-5-hydroxy-1,3,5-triazine | 30 mg/m$^2$ |

(Preparation of solid developing agent for black-and white use)

Composition A

| | |
|---|---|
| Polyethylene glycol (the molecular weight is 2000) | 600 g |
| Sodium sulfite | 870 g |
| Hydroquinone | 1280 g |
| 1-phenyl-3-pyrazolidone | 43 g |

Composition B

| | |
|---|---|
| Potassium carbonate | 364 g |
| Sodium carbonate | 790 g |
| Sodium sulfite | 2500 g |
| Sodium hydroxide | 630 g |

Composition C

| | |
|---|---|
| Polyethylene glycol (the molecular weight is 2000) | 1400 g |
| 5-nitro-indazole | 10 g |
| 1-phenyl-5-mercaptotetrazole | 2 g |
| 5-methyl-benzotriazole | 14 g |
| Compound GB-1 | 5.4 g |
| Compound GB-2 | 27 g |

Sensitizing dye:

SD-2

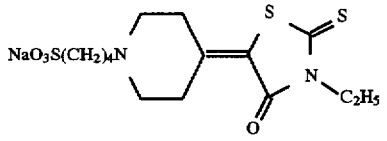

SD-3

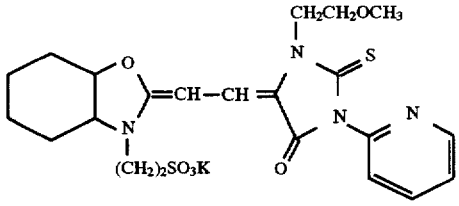

-continued
Water-soluble dye-1
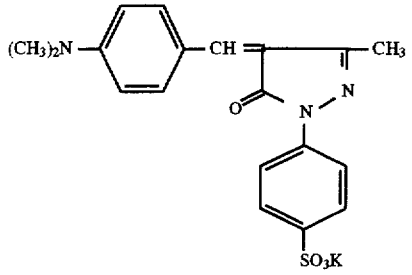
Water-soluble dye-2
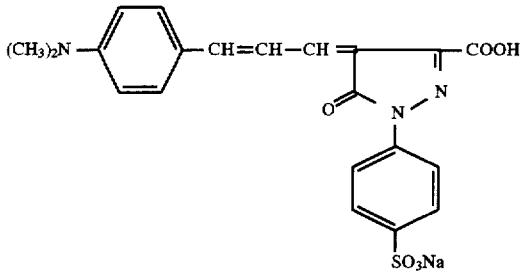
Water-soluble dye-3
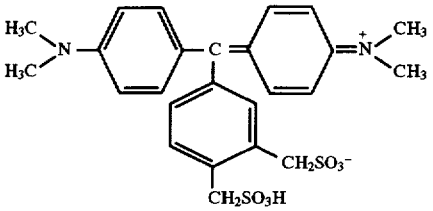
S-2
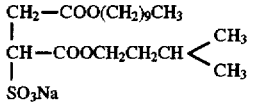
SD-1
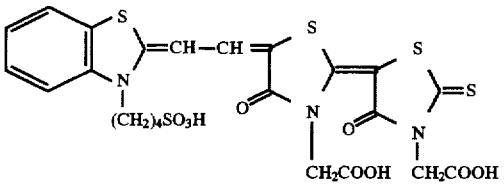
P-1
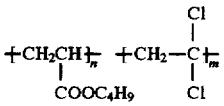
(n:m = 50:50)
ST-1
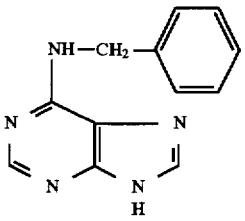
S-1
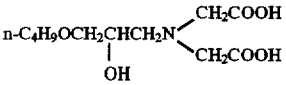
FA-33
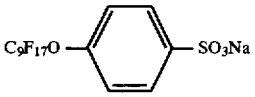

-continued

H-12

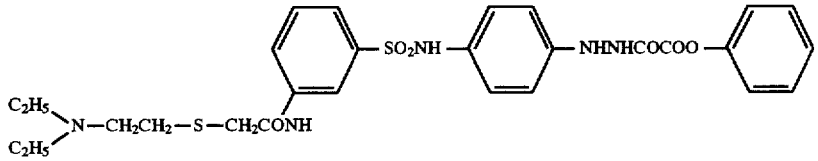

(Na-9)

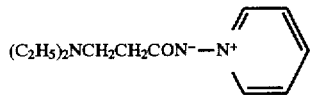

GB-1

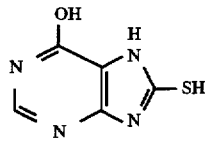

GB-2

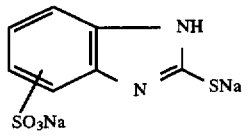

E-2

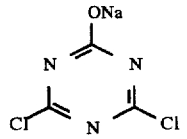

After a component of Composition A was mixed uniformly, 10 wt % of water was added thereto as a binder for granulating the mixture with a pressure-type granulating machine. The granulated product was dried while blowing hot air at 70° C. The resulting granulated product had a diameter of 3 mm and a length of 3 mm were obtained. With regard to Compositions B and C too, in the same manner as in the above-mentioned product, granulated products each having a diameter of 0.5 mm and a length of 0.6 mm and a diameter of 0.6 mm and a length of 3 mm. These three parts were mixed uniformly so that a solid black-and-white developing composition was obtained. This developing composition was dissolved in 90 liter of water. In this occasion, pH was 10.4.

(Preparation of solid fixing agent for black and white use)

| | |
|---|---|
| Composition A | |
| Polyethylene glycol (the molecular weight is 2000) | 190 g |
| Ammonium thiosulfate | 1350 g |
| Sodium sulfite | 50 g |
| Composition B | |
| Polyethylene glycol (the molecular weight is 2000) | 120 g |
| Anhydrous ammonium sulfate | 69 g |
| Boric acid | 67 g |
| Citric acid | 400 g |
| Sodium salt of citric acid | 300 g |

After a component of Composition A was mixed uniformly, 10 wt % of water was added thereto as a binder for granulating the mixture with a pressure-type granulating machine. The granulated product was dried while blowing hot air at 70° C. The resulting granulated product had a diameter of 3 mm and a length of 3 mm. With regard to Composition B, in the same manner as in the above-mentioned product, granulated products each having a diameter of 0.5 mm and a length of 3 mm. These parts were mixed uniformly so that a solid black-and-white developing composition was obtained. This developing composition was dissolved in 10 liter of water.

(Comparative liquid developing composition and fixing composition)

As a comparative developing composition and a fixing composition, CDM-671 and CFL-871 produced by Konica which are liquid processing solution were respectively used for an experiment.

The resulting samples were processed with an automatic processing machine GR-27 produced by Konica under Dry to dry of 90". In addition, Table 1 shows the amount of washing water, whether or not there is an water-dust saving apparatus and whether or not there is a stabilizing solution.

Here, for the water-dust saving apparatus, a water-dust preventing apparatus described in Japanese Patent O.P.I. Publication No. 333512 was used for working.

Next, the amount of residual silver, the amount of residual fixing agent and the amount of residual developing agent were measured for evaluating bleachability, water washing property and image storage stability. (The smaller the amount of residual fixing agent and the amount of residual developing agent is, the better the water washing property and image storage stability are.)

(Measuring method of the amount of residual silver)

A 0.2% $Na_2S$ aqueous solution was dropped on an unexposed portion of processed dry sample. After leaving it for 3 minutes, the remaining solution was blotted up with a blotting paper. Following this, the sample was subjected to natural drying. The transmission densities of portion decolored with $Na_2S$ aqueous solution and portion where $Na_2S$ aqueous solution was not dropped were measured with a blue light. The difference between them was defined to be the amount of residual silver.

The amount of residual silver of each sample of the present invention is preferably 0.20 or less, more preferably 0.10 or less and most preferably 0.05 or less.

(Measuring method of the amount of residual fixing agent)

After mixing 125 cc of a 28% acetic acid solution and 7.5 g of silver nitrate with 750 cc of pure water, making 1000 cc with pure water, and the resulting solution is employed as a detecting solution. The detecting solution was dropped on an unexposed portion of dry sample after processed. After leaving it for 3 minutes, the residual solution was blotted up with a blotting paper. Following this, the sample was subjected to natural drying, and then, the transmission densities of a portion decolored with the detecting solution and a portion where the detecting solution was not dropped were measured with a blue light. The difference between them was defined to be the amount of residual fixing agent. The amount of residual fixing agent of the sample processed with a processing method of the present invention is preferably 0.40 or less, more preferably 0.30 or less and most preferably 0.20 or less.

(Measuring method of the amount of residual developing agent)

Each sample processed was cut to 3 cm square, and then, immersed in a pure water at 25° C. The resulting solution was subjected to quinone quantitation of an oxidized product of the developing agent with high speed liquid chromatography. This value was defined to be the amount of residual developing agent. The amount of residual developing agent of the sample processed with a processing method of the present invention is preferably 1 mg/m$^2$ or less. The results are shown as follows:

TABLE 1

| Test No. | Processing composition | Replenished amount of water (L/m$^2$) | Water-dirt water saving | Amount of residual silver | Amount of residual fixing agent | Amount of residual developing agent (mg/m$^2$) | Remarks |
|---|---|---|---|---|---|---|---|
| 1-1 | Liquid | 12 | — | 0.03 | 0.10 | 0.4 | Comp. |
| 1-2 | Liquid | 6 | — | 0.05 | 0.23 | 0.9 | Comp. |
| 1-3 | Liquid | 2.5 | — | 0.09 | 0.42 | 2.0 | Comp. |
| 1-4 | Liquid | 0.5 | — | 0.15 | 0.54 | 3.5 | Comp. |
| 1-5 | Solid | 12 | — | 0.01 | 0.04 | 0.07 | Comp. |
| 1-6 | Solid | 6 | — | 0.02 | 0.09 | 0.13 | Comp. |
| 1-7 | Solid | 2.5 | — | 0.03 | 0.14 | 0.23 | Inv. |
| 1-8 | Solid | 0.5 | — | 0.04 | 0.19 | 0.61 | Inv. |
| 1-9 | Solid | 2.5 | used | 0.02 | 0.15 | 0.15 | Inv. |
| 1-10 | Solid | 0.5 | used | 0.04 | 0.20 | 0.52 | Inv. |

As is apparent from above, the samples of the present invention have preferable desilvering property even when the replenished amount of waster is 3 l/m$^2$ or less. In addition, with regard to water washing property and image storage stability too, the samples of the represent invention show excellent results.

Example 2

Preparation of light-sensitive material (Preparation of emulsion)

To a gelatin solution, a silver nitrate solution and a solution wherein rhodium hexachloride complex was added to an aqueous potassium bromide solution in a manner of $8\times10^{-5}$ mol per mol of silver were added concurrently while controlling flow rate. After desalting a mono-dispersed silver bromochloride emulsion (silver bromide content of 1 mole %) containing a cubic crystal having a particle size of 0.13 μm, were obtained.

This emulsion was subjected to sulfur sensitization by means of a conventional method. After adding 6-methyl-4-hydroxy-1,3,3a,7-tetrazaindene thereto as a stabilizer, the following additive was added to the resulting solution for preparing an emulsion coating solution. Next, emulsion intermediate layer coating solution M-O, emulsion protective layer coating solution P-O, backing layer coating solution B-O and backing protective layer coating solution BP-O were prepared in the following composition.

(Preparation of emulsion coating solution)

| | |
|---|---|
| NaOH(0.5N) | regulated to pH 6.5 |
| Compound (b) | 40 mg/m$^2$ |
| Saponin (20%) | 0.5 cc/m$^2$ |
| Sodium salt of dodecylbenzene sulfonic acid | 20 mg/m$^2$ |
| 5-methylbenzotriazole | 10 mg/m$^2$ |
| Compound (f) | 6 mg/m$^2$ |
| Polymer latex (a) | 0.5 mg/m$^2$ |
| Hydrophilic polymer of styrene-maleic acid copolymer (viscosity-increasing agent) | 90 mg/m$^2$ |
| Gelatin | 1.2 g/m$^2$ |
| Amount of silver | 3.5 g/m$^2$ |

(a) 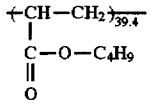

-continued

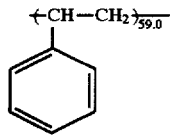

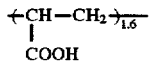

-continued (b)

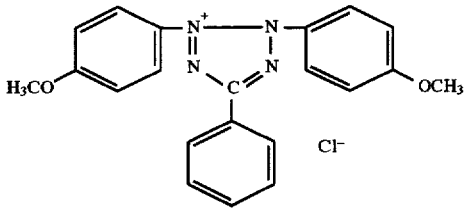

(f)

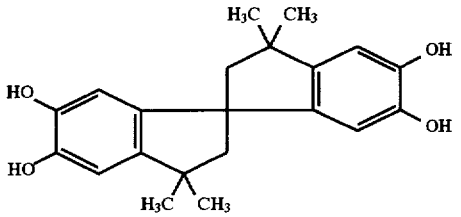

(Emulsion intermediate layer coating solution M-O)

| | |
|---|---|
| Gelatin | 0.5 g/m$^2$ |
| Compound (g) | 10 mg/m$^2$ |
| Citric acid | pH was regulated to 6.0 |
| Hydrophilic polymer of styrene maleic acid copolymer (the above-mentioned viscosity increasing agent) | 45 mg/m$^2$ |

(Emulsion protective layer coating solution P-O)

| | |
|---|---|
| Gelatin | 0.3 g/m$^2$ |
| Compound (g) | 12 mg/m$^2$ |
| Spherical mono-dispersed silica (4 μm) | 8 mg/m$^2$ |
| Compound (h) | 100 mg/m$^2$ |
| Citric acid | pH was adjusted to 6.0 |
| Dye I | 120 mg/m$^2$ |

(Backing layer coating solution B-O)

| | |
|---|---|
| Gelatin | 1.5 g/m$^2$ |
| Compound (i) | 100 mg/m$^2$ |
| Compound (j) | 18 mg/m$^2$ |
| Compound (k) | 100 mg/m$^2$ |
| Saponin (20%) | 0.6 cc/m$^2$ |
| Latex (l) | 300 mg/m$^2$ |
| 5-nitroindazole | 20 mg/m$^2$ |
| Hydrophilic polymer of styrene maleic acid copolymer (the above-mentioned viscosity increasing agent) | 45 mg/m$^2$ |
| Glyoxazol | 4 mg/m$^2$ |
| Compound (m) | 100 mg/m$^2$ |

(Backing protective layer coating solution BP-O)

| | |
|---|---|
| Gelatin | 0.8 g/m$^2$ |
| Compound (g) | 10 mg/m$^2$ |
| Spherical polymethylmethacrylate (4 μm) | 25 mg/m$^2$ |
| Sodium chloride | 70 mg/m$^2$ |
| Glyoxazal | 22 mg/m$^2$ |

(g)

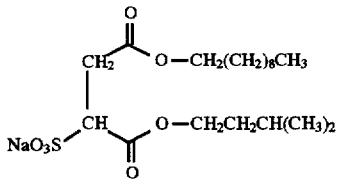

(h)

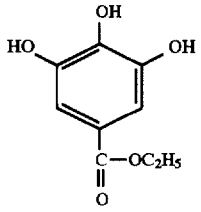

-continued

Dye I

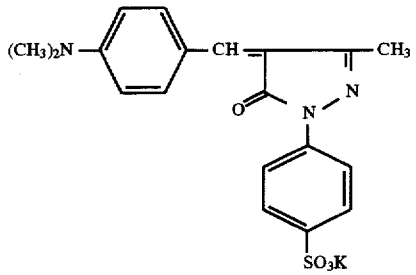

(i)

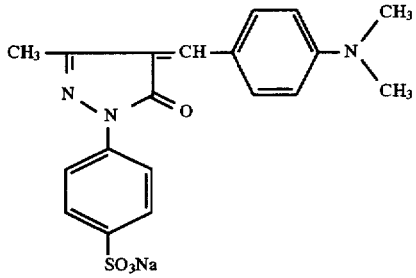

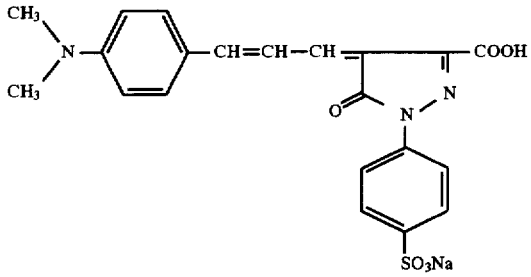

(k)

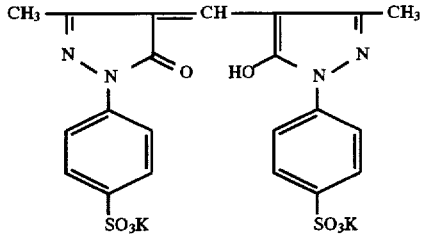

(l)

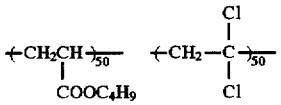

(m)

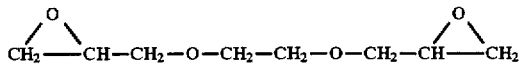

Apart from above, a polyethylene terephthalate base provided with subbing as described in Japanese Patent O.P.I. Publication No. 19941/1984 whose thickness is 100 μm was subjected to corona discharge at 10 W/(m$^2$·min). Following this, the following compositions were coated by means of a roll fit coating pan and air knife. Drying was conducted under a parallel flow drying condition at 90° C. and the total coefficient of heat transfer of 25 Kcal (m$^2$·hr·°C.). Next, drying was conducted at 140° C. for 90 seconds. The layer thickness after drying was 1 μm and the specific surface resistance of this layer was $1\times10^8$ Ω at 23° C. and 55%RH.

Water-soluble polymer 70 g/l

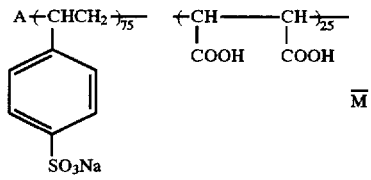

$\overline{M}$ = 5000

Hydrophobic polymer 40 g/l

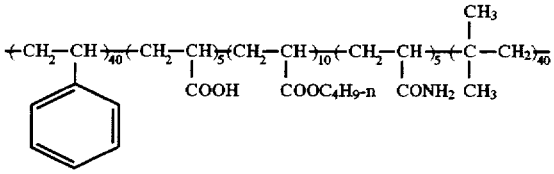

| | |
|---|---|
| Ammonium sulfate | 0.5 g/l |
| Polyethylene oxide compound (the average molecular weight was 600) (n) | 6 g/l |
| Hardener (o) | 12 g/l |

(n) Mixture of

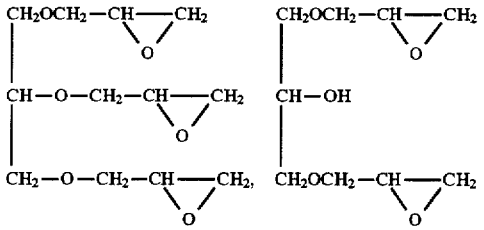

and

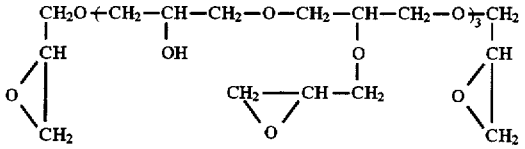

(o)

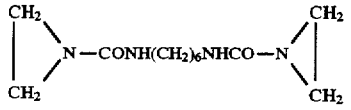

(p) $(CH_2=CH-SO_2CH_2)_4C$

On a base subjected to the above-mentioned preprocessing, an emulsion layer, an emulsion intermediate layer and an emulsion protective layer were coated in this order from a support side concurrently while adding 60 mg/m$^2$ of formaldehyde which is a hardener by means of a slide hopper method at 35° C. After passing chilled air zone (5° C.), a backing layer and a backing protective layer were coated by means of a slide hopper while adding 100 mg/m$^2$ of the above-mentioned hardener compound (p), and then chilled air was set (5° C.). At point where each set zone was passed, the coating solution showed sufficient set property. Succeedingly, both surfaces were dried concurrently in a drying zone. Incidentally, after coating a backing surface side, the base was conveyed not contacting rollers and others until winding. At this point, the coating speed was 100 m/min. In this occasion, the coating amount of silver was 3.5 g/m$^2$.

A light-sensitive material thus obtained was exposed to light in a manner to achieve blackening ratio of 20%. Following this, processing was conducted for 200 sheets per day during 4 days. An automatic processing machine was GR-26SR produced by Konica provided with a replenishing agent of 5 l supplying tank having a capacity of 5 l and a nozzle for replenishing water. The amount of circulation was set to 1 rotation/min. A developing solution inside a tank in starting is shown as follows:

| Processing steps | | |
|---|---|---|
| Developing | 35° C. | 15 seconds |
| Fixing | 33° C. | 10 seconds |
| Washing | room temperature | 10 seconds |
| drying | 40° C. | 10 seconds |

Under the following procedures (A and B), a tablet for replenishment developer use was prepared.

Procedure (A)

In a commercially available bandam mill, 1400 g of hydroquinone which is a developing agent was crushed until the average particle size to be 10 μm. To this fine powder, 1466 g of sodium sulfite, 3515 g of potassium sulfite and 140 g of dimezone S were added. In the mill, the mixture was mixed for 30 minutes, and then, in a commercially available stirring granulating machine, 30 ml of water was added thereto spending 10 minutes for granulating. Following this, the granulated product was dried with a fluidized bed drier at 40° C. for 2 hours so that moisture in the granulated product was almost completely removed. To the prepared granulated product prepared in the above-mentioned manner, 100 g of polyethylene glycol 6000 was added, and then, the resulting mixture was mixed uniformly by the use of a mixer in a room at 25° C. and 40%RH. Next, the resulting mixture was compressed for a tablet with a tableting machine wherein a Tough Press Correct 1527HU produced by Kikusui Seisakusho was modified in a manner that the amount of filling per one tablet was 2.65 g so that 2500 tablets of tablet A for development replenishing use were prepared.

Procedure (B)

In the same manner as in Procedure (A), 100 g of EDTA·2Na, 250 g of potassium bromide, 4000 g of potassium carbonate, 50 g of 5-methylbenzotriazole, 2 g of 1-phenyl-5-mercapto tetrazole, 6 g of 2-mercaptohypoxantin and 200 g of KOH were crushed and granulated. The added amount of water was 30.0 ml. After granulating, the granulated product was dried for 30 minutes at 50° C. so that moisture contained therein was almost completely removed. The resulting mixture was subjected to compressing for tableting with a tableting machine in which Tough Press correct 1527 HU produced by Kikusui Seisakusho wherein the amount of filling was 1.84 g. Thus, 2500 tablet of tablet B for development replenishing use were prepared.

During running, a light-sensitive material was processed while supplying 2 tablets respectively of the above-mentioned tablets A and B per a big sheet of paper. The amount of replenishing water was regulated to be 10 ml/hour during processing (in temperature-regulating) (Processing condition A). As a comparative, 13.32 ml of the condensed solution of starting solution and 26.68 ml of water were replenished for running per a big sheet of paper (Processing condition B).

(Comparative liquid developing composition and fixing composition)

As a comparative developing solution and fixing solution, CDM-671 and CFL-871 produced by Konica which are liquid processing solutions were respectively used for an experiment.

In addition, the amount of washing water and whether or not there is a water-dust saving apparatus are shown in Table 2.

Here, with regard to the water-dust saving apparatus, a water-dust preventing apparatus described in Japanese Patent O.P.I. Publication No. 333512/1993 was used for working.

Next, the amount of residual silver in each sample, the amount of residual fixing agent and the amount of residual developing agent were measured in the same manner as in Example 1 for evaluating bleachability, water washing property and image storage stability.

The results are shown as follows.

TABLE 2

| Test No. | Light-sensitive material | Processing composition | Replenished amount of water | Water-dirt water saving | Amount of residual silver | Amount of residual developing agent | Amount of residual fixing agent (mg/m²) | Remarks |
|---|---|---|---|---|---|---|---|---|
| 2-1 | 1 | Liquid | 8 | — | 0.01 | 0.10 | 0.2 | Comp. |
| 2-2 | 1 | Liquid | 5 | — | 0.02 | 0.21 | 0.4 | Comp. |
| 2-3 | 1 | Liquid | 2.5 | — | 0.05 | 0.53 | 1.5 | Comp. |
| 2-4 | 1 | Liquid | 0.5 | — | 0.10 | 0.82 | 3.2 | Comp. |
| 2-5 | 1 | Tablet | 8 | — | 0.01 | 0.03 | 0.04 | Comp. |
| 2-6 | 1 | Tablet | 5 | — | 0.01 | 0.04 | 0.06 | Comp. |
| 2-7 | 1 | Tablet | 2.5 | — | 0.01 | 0.09 | 0.11 | Inv. |
| 2-8 | 1 | Tablet | 0.5 | — | 0.02 | 0.18 | 0.31 | Inv. |
| 2-9 | 1 | Tablet | 2.5 | used | 0.01 | 0.03 | 0.15 | Inv. |
| 2-10 | 1 | Tablet | 0.5 | used | 0.02 | 0.21 | 0.29 | Inv. |
| 2-11 | 2 | Liquid | 8 | — | 0.01 | 0.15 | 0.21 | Comp. |
| 2-12 | 2 | Liquid | 5 | — | 0.03 | 0.28 | 0.43 | Comp. |
| 2-13 | 2 | Liquid | 2.5 | — | 0.08 | 0.62 | 1.8 | Comp. |
| 2-14 | 2 | Liquid | 0.5 | — | 0.15 | 0.93 | 2.9 | Comp. |
| 2-15 | 2 | Tablet | 8 | — | 0.01 | 0.07 | 0.05 | Comp. |
| 2-16 | 2 | Tablet | 5 | — | 0.01 | 0.14 | 0.07 | Comp. |
| 2-17 | 2 | Tablet | 2.5 | — | 0.02 | 0.21 | 0.13 | Inv. |
| 2-18 | 2 | Tablet | 0.5 | — | 0.03 | 0.31 | 0.34 | Inv. |
| 2-19 | 2 | Tablet | 0.5 | used | 0.03 | 0.26 | 0.34 | Inv. |

As is apparent from the above, the samples of the present invention shows excellent bleachability even when the replenished amount of water was 3 l/m² or less. In addition, their water washing property and image storage stability were also excellent.

Example 3

Preparation of light-sensitive material

<Light-sensitive material-I>

Preparation of Seed emulsion-1

In the following manner, Seed emulsion-1 was prepared.

| | | |
|---|---|---|
| A1 | Ossein gelatin | 24.2 g |
| | Water | 9657 ml |
| | Sodium polypropyreneoxy-polyethyleneoxy-disuccinate (10% aqueous ethanol solution) | 6.78 ml |
| | Potassium bromide | 10.8 g |
| | 10% nitric acid | 114 ml |
| B1 | 2.5 N silver nitrate aqueous solution | 2825 ml |
| C1 | Potassium bromide | 841 g |
| | Water was added to make 2825 ml. | |
| D1 | 1.75 N potassium bromide aqueous solution | Amount for controlling the following silver potential |

To Solution A1, 464.3 ml of Solutions B1 and C1 respectively were added by means of a double jet method at 42° C. by the use of a mixing stirrer described in Japanese Patent Publication Nos. 58288/1983 and 58289/1983 spending 1.5 minutes for forming nuclei.

After stopping the addition of solutions B1 and C1, the temperature of Solution A1 was raised to 60° C. spending 60 minutes. After regulating pH to 5.0 with 3% KOH, Solutions B1 and C1 were added again by means of the double jet method at the flow rate of 55.4 ml/min for 42 minutes. The temperature was raised from 42° C. to 60° C., and silver potential (With saturated silver—a silver chloride electrode as a comparative electrode, the silver potential was measured by a silver ion selecting electrode) during concurrent mixture was controlled to be +8 mV and +16 mV respectively by the use of Solution D1.

After completion of adding, pH was regulated to 6 with 3% KOH. Immediately following this, the resulting solution was subjected to desalting and washing. This seed emulsion was composed of a hexagonal tabular grain wherein the maximum adjacent side ratio of 90% or more of the total projected area of silver halide grains is 1.0 to 2.0. It was observed by means of an electron microscope that the average thickness of the hexagonal tabular grain was 0.064 μm and the average grain size (converted to a circle diameter) was 0.595 μm. In addition, variation coefficient of thickness was 40% and variation coefficient of distance between a twinned surface was 42%.

Preparation of Em-1

By the use of Seed emulsion-1 and the following 4 kinds of solutions, a tabular silver halide emulsion Em-1 was prepared.

| | | |
|---|---|---|
| A2 | Ossein gelatin | 34.03 g |
| | Sodium polypropyreneoxy-polyethyleneoxy-disuccinate (10% aqueous ethanol solution) | 2.25 ml |
| | Seed emulsion-1 | equivalent to 1.218 mol |
| | Water was added to make 3150 ml. | |
| B2 | Potassium bromide | 1734 g |
| | Water was added to make 3644 ml. | |
| C2 | Silver nitrate | 2478 g |
| | Water was added to make 4165 ml. | |

-continued

| | | |
|---|---|---|
| D2 | Fine grain emulsion composed of 3 wt % of gelatin and silver iodide grains (the average grain size was 0.05 μ) (*) | equivalent to 0.080 mol |

*To 6.64 liter of 5.0 wt % aqueous gelatin solution containing 0.06 mol of potassium iodide, 2 liter of aqueous solution containing 7.06 mol of silver nitrate and 2 liter of aqueous solution containing 7.06 mol of potassium iodide were added respectively in 10 minutes. During forming fine grains, pH was regulated to 2.0 and the temperature was adjusted to 40° C. After forming the grains, pH was regulated to 6.0 by the use of sodium carbonate aqueous solution.

In a reacting container, Solution A2 was stirred vigorously while keeping the temperature at 60° C. To it, a part of Solution B2, a part of Solution C2 and half amount of Solution D2 were added in 5 minutes by the double jet method. Following this, half amount of the remaining amount of Solution B2 and Solution C2 were added in 37 minutes. Succeedingly, a part of Solutions B2 and C2 and the all remaining Solution D2 were added in 15 minutes. Finally, all of remaining Solutions B2 and C2 were added in 33 minutes. During this, pH was kept at 5.8 and pAg was kept at 8.8. Here, adding speed of Solutions B2 and C2 was changed functionally to time meeting the critical growth speed.

In addition, the above-mentioned Solution D2 was added equivalent to 0.15 mol % to the total silver amount for halogen substitution.

After completion of adding, this emulsion was cooled to 40° C. As a polymer agent for coagulation, 1800 ml of a 13.8% (by weight) denauted gelatin aqueous solution (the substitution ratio was 90%) denauted with a phenylcarbamoyl group was added thereto and the resulting solution was stirred for 3 minutes. Following this, an aqueous 56% (by weight) acetic acid solution was added thereto. pH of the emulsion was regulated to 4.6. The mixture was stirred for 3 minutes. Following this, the mixture was left for 20 minutes. By means of decantation, a supernatant was ejected. Following this, 9.0 l of distilled water at 40° C. was added. After stirring and leaving, the supernatant was ejected. In addition, 11.25 l of distilled water was added thereto. After stirring and leaving, the supernatant was ejected. Succeedingly, to the resulting solution, an aqueous gelatin solution and an aqueous 10% (by weight) sodium carbonate solution were added. pH was regulated to 5.80. The solution was stirred for 30 minutes at 50° C., and then, the mixture was re-dispersed. After re-dispersing, pH was regulated to 5.80 and pAg was regulated to 8.06 at 40° C.

When the resulting silver halide emulsion was observed with an electron microscope, it was found a tabular silver halide grains whose average grain size was 1.11 μm, the average thickness was 0.25 μm, the average aspect ratio was about 4.5 and the width of grain size was 18.1%. In addition, the average distance between twinned crystal surfaces was 0.020 μm. The number of grain whose ratio between the twinned crystal surfaces and the thickness is 5 or more occupied 97% (by number) of the total tabular silver halide grains, the ratio thereof is 10 or more occupied 49% and the ratio thereof is 15 or more occupied 17%.

Next, after raising the temperature of the above-mentioned emulsion Em-1 to 60° C., a prescribed amount of spectral sensitizing dye was added thereto as a solid grain dispersed product. Following this, an aqueous mixed solution of adenine, ammonium thiocyanate, chloro aurate and sodium thiosulfate and a dispersed solution of triphenylphosphine selenide were added thereto. In addition, 60 minutes later, a silver iodide grain emulsion was added thereto. The resulting mixture was subjected to ripening for 2 hours in total. After completion of ripening, as a stabilizer, 4-hydroxy-6-methyl-1,3,3a,7-tetrazaindene (TAI) was added in a prescribed amount.

Incidentally, the above-mentioned additives and their amount of adding (per mol of AgX) will be given as follows:

| | |
|---|---|
| Anhydrous sodium salt of 5,5'-dichloro-9-ethyl-3,3'-di-(3-sulfopropyl)oxacarbocyanine | 2.0 mg |
| Anhydrous sodium salt of 5,5'-di-(buthoxycarbonyl)-1,1'-diethyl-3,3'-di-(4-sulfobutyl)benzimidazolocarbo cyanine | 120 mg |
| Adenine | 15 mg |
| Potassium thiocyanate | 95 mg |
| Chloro aurate | 2.5 mg |
| Sodium thiosulfate | 2.0 mg |
| Triphenylphosphine selenide | 0.4 mg |
| Silver iodide grain | 280 mg |
| 4-hydroxy-6-methyl-1,3,3a,7-tetrazaindene (TAI) | 500 mg |

The solid grain dispersed product of the spectral sensitizing dye was prepared in accordance with a method described in Japanese Patent Application No. 99437/1992. Namely, a prescribed amount of spectral sensitizing dye was added to water whose temperature had been regulated to 27° C. in advance. The resulting was stirred for 30 to 120 minutes at 3,500 rpm with a high speed stirrer (dissolver) for obtaining the solid grain dispersed product.

The above-mentioned dispersed solution of selenium sensitizer was prepared in the following manner, namely, 120 g of triphenylphosphine selenide was added to 30 kg of acetic acidethyl at 50° C. and stirred for completely dissolving. On the other hand, 3.8 kg of photographic gelatin was dissolved in 38 kg of pure water. To this mixture, 93 g of an aqueous 25 wt % sodium dodecylbenzene sulfonic acid was added. Next, the above-mentioned two solutions were mixed and subjected to dispersing at a dispersion wing circumference speed of 40 m/sec. for 30 minutes at 50° C. with a high speed stirrer type dispersing machine having a disolver whose diameter is 10 cm. Following this, while evacuating speedily, the dispersed solution was stirred until the remaining density of the acetic acidethyl becomes 0.3 wt % or less for removing acetic acid ethyl. Following this, this dispersed solution was diluted with pure water to make 80 kg of a mixture. Thus, a part of the resulting dispersed solution was separated out for using for the above-mentioned experiment.

Incidentally, due to addition of the above-mentioned silver iodide grains, the average iodide content on the outermost surface of the silver halide grains contained in silver halide emulsion (Em-1) was about 4 mol %.

Next, to the emulsion sensitized in the above-mentioned manner, additives described later were added for preparing an emulsion layer coating solution, concurrently with this, a protective layer coating solution was also prepared.

Next, on both surfaces of a support wherein the following crossing-light shielding layer was coated in advance on both surface of polyethylene terephthalate film base for X ray use colored to blue at density of 0.15 (the thickness was 175 μm), the above-mentioned emulsion layer coating solution and a protective layer coating solution were coated concurrently from the bottom with the following prescribed coating amount, and then, dried.

1st layer (crossing light shielding layer)

| | |
|---|---|
| Solid grain dispersed dye (AH) | 180 mg/m$^2$ |
| Gelatin | 0.2 g/m$^2$ |
| Sodium salt of dodecylbenzenesulfonic acid | 5 mg/m$^2$ |
| Compound (I) | 5 mg/m$^2$ |
| Sodium salt of 2,4-dichloro-6-hydroxy-1,3,5- | 5 mg/m$^2$ |

-continued

| | |
|---|---|
| triazine | |
| Colloidal silica (the average grain size is 0.014 μm) | 10 mg/m$^2$ |

2nd layer (Emulsion layer)

To each emulsion obtained as above, the following each additive was added.

| | |
|---|---|
| Compound (G) | 0.5 mg/m$^2$ |
| 2,6-bis(hydroxyamino)-4-diethylamino-1,3,5-triazine | 5 mg/m$^2$ |
| t-butyl-catecol | 130 mg/m$^2$ |
| Polyvinyl pyrrolidone (the molecular weight is 10,000) | 35 mg/m$^2$ |
| Styrene-maleic acid copolymer | 80 mg/m$^2$ |
| Sodium salt of polystyrene sulfonic acid | 80 mg/m$^2$ |
| Trimethylol propane | 350 mg/m$^2$ |
| Diethylene glycol | 50 mg/m$^2$ |
| Nitrophneyl-triphenyl-phosphonium chloride | 20 mg/m$^2$ |
| Ammonium 1,3-dihydroxybenzene-4-sulfonic acid | 500 mg/m$^2$ |
| Sodium salt of 2-mercaprobenzimidazole-5-sulfonic | 5 mg/m$^2$ |
| Compound (H) | 0.5 mg/m$^2$ |
| m-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica | 0.5 mg/m$^2$ |
| Latex (L) | 0.2 mg/m$^2$ |
| Dextrin (the average molecular weight is 1000) | 0.2 mg/m$^2$ |

The above-mentioned compounds were adjusted to 1.0 g/m$^2$ in terms of gelatin.

3rd layer

| | |
|---|---|
| Gelatin | 0.8 g/m$^2$ |
| Matting agent composed of polyethylmethacrylate (the average rain size by area is 7.0 μm) | 50 mg/m$^2$ |
| Formaldehyde | 20 mg/m$^2$ |
| Sodium salt of 2,4-dichloro-6-hydroxy-1,3,5-triazine | 10 mg/m$^2$ |
| Bis-vinylsulfonylmethylether | 36 mg/m$^2$ |
| Latex (L) | 0.2 g/m$^2$ |
| Polyacrylic amide (the average molecular weight is 10000) | 0.1 g/m$^2$ |
| Sodium salt of polyacrylic acid | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}$—O—$(CH_2CH_2O)_{11}$—H | 3 mg/m$^2$ |
| $C_8F_{17}SO_2N(C_3H_7)$ $(CH_2CH_2O)_{15}$—H | 2 mg/m$^2$ |
| $C_8F_{17}SO_2N(C_3H_7)$ $(CH_2CH_2O)_4$—$(CH_2)_4SO_3Na$ | 1 mg/m$^2$ |

Incidentally, the amount added of each material is for one surface. The coating amount of silver was regulated to 1.6 g/m$^2$ per one surface.

Compounds used will be exhibited as follows:

Compound (G)

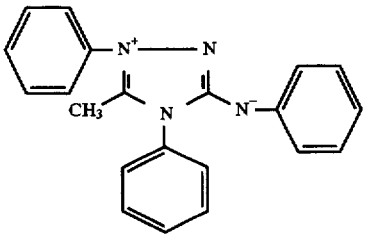

-continued

Compound (H)

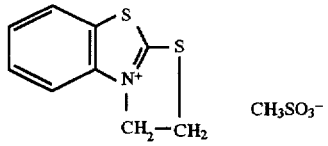

Compound (I)

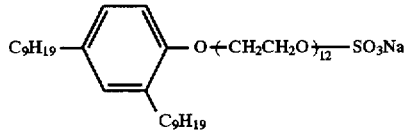

Compound (J)

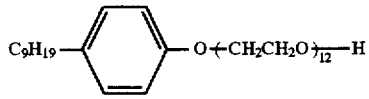

Compound (K)

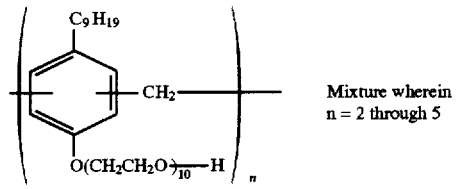

Mixture wherein n = 2 through 5

Compound (S-1)

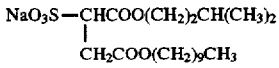

Compound (S-2)

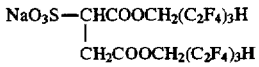

Latex (L)

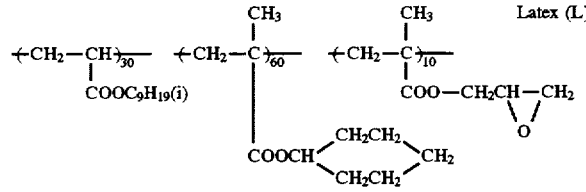

Polysiloxane (SI)

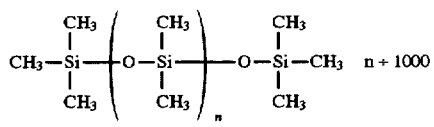

n + 1000

Solid particle dispersed dye (AH)

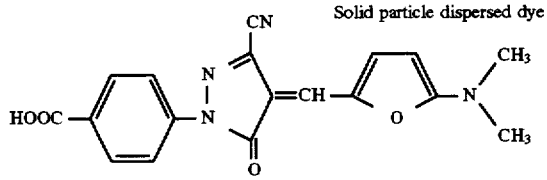

Compound (O)

$C_{11}H_{23}CONH(CH_2CH_2O)_5H$

Compound (M)

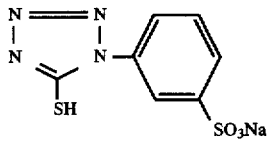

Compound (N)

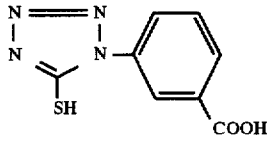

<Light-sensitive material-2>

[Preparation of emulsion]

While controlling at 60° C., pAg of 8 and pH of 2.0, a mono-dispersed cubic crystal of silver bromoiodide containing 2 mol % of silver iodide whose average grain size was 0.13 μm by means of a double jet method. In this emulsion, the occurrence ratio of twinned crystal grain was 1% or less by number according to an electron microscopic photography.

With this emulsion as a seed crystal, it was grown as follows:

Namely, to a protective gelatin kept at 40° C. and, if necessary, 8.0 liter of solution containing ammonia, this seed crystal was dispersed. In addition, by means of acetic acid, pH was regulated.

With the resulting solution as an initial solution, 3.2N ammonia silver nitrate solution, potassium bromide and an aqueous potassium iodide solution were added by means of the double jet method.

Namely, while controlling pAg to 7.3 and pH to 9.7, a layer containing 35 mol % of silver iodide was formed. Next, pH was changed to 9.0 to 8.0, and then, ammonia silver nitrate and potassium bromide solution were added thereto for growing. During growing, potassium bromide solution was added with a nozzle spending 8 minutes. pH was reduced to 11.0, and 3 minutes after adding of potassium bromide. This emulsion was a tetradecahedron mono-dispersed emulsion wherein the average grain size was about 0.3 μm and corners were rounded. The average silver iodide content of the total grains was 1.5 mol %.

Next, in order to remove excessive soluble salt in the above-mentioned reacted solution, the reacted solution was subjected to desalting process. Namely, while keeping the reacted solution at 40° C., formaldehyde condensed product of sodium naphthalene sulfonic acid and magnesium sulfate were added thereto. The mixture was stirred and left. By means of a decantation method, excessive salts were removed.

Next, to the emulsion after being desalted at 55° C., ammonium thiocyanate, chloro aurate and sodium thiosulfate were added for chemical sensitization. Next, 20 mg/Ag mol of the following spectral sensitizing dye-1 and 20 mg/Ag mol of the following spectral sensitizing dye-2 were added for spectral sensitization.

Sensitizing dye-1

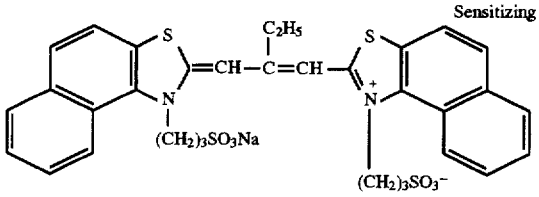

Sensitizing dye-2

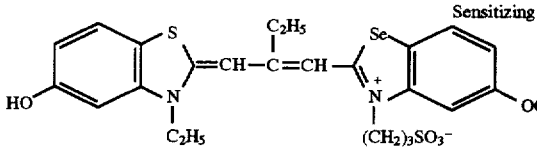

At the maximum sensitivity, 1.2 g of 4-hydroxy-6-methyl-1,3,3a,7-tetrazaindene was added per mol of silver halide for stabilizing. Thus, an emulsion coating solution was prepared.

Incidentally, the following additives were added to the emulsion coating solution per mol of silver halide.

| | |
|---|---|
| Nitrophenyl-triphenyl phosphonium chloride | 30 mg |
| Ammonium 1,3-dihydroxybenzene-4-sulfonium | 1 g |
| Sodium salt of 2-mercaptobenzimidazole-5-sulfonic | 10 mg |
| 2-mercaptobenzothiazole | 10 mg |
| Trimethylol propane | 9 g |
| 1,1-dimethylol-1-bromo-1-nitromethane | 10 mg |
| $C_4H_9OCH_2CH(OH)CH_2N(CH_2COOH)_2$ | 1 g |
| 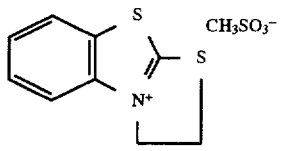 | 35 mg |
| 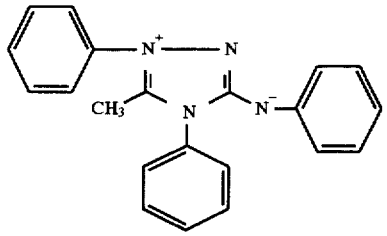 | 60 mg |

In addition, the composition of the emulsion protective layer solution was as follows. The added amounts are shown per 1 liter of coating solution.

| | |
|---|---|
| Lime-processed inert gelatin | |
| Acid-processed gelatin | 2 g |
| α-sulfosuccinic acid didecylester sodium salt | 0.3 g |
| Polymethylmethacrylate (the average grain size by area is 4 μm) | 1.1 g |
| Silicone dioxide (matting agent whose average grain size by area is 1.2 μm) | 0.5 g |
| Ludox AM ™ (colloidal silica produced by Du Pont ™) | 30 g |
| 2% aqueous solution of sodium salt of 2,4-dichloro-6-hydroxy-1,3,5-triazine (hardener) | 10 ml |
| An aqueous 35% formalin solution (hardener) | 2 ml |
| An aqueous 40% glyoxal solution (hardener) | 1.5 ml |
| [UV absorber additive] | |
| Compound BH | 10 mg |
| Ethylacetic acid | 7.5 ml |
| Water | 30 ml |
| Gelatin | 2.5 g |

As a backing layer, a backing layer composed of 400 g of gelatin, 2 g of polymethylmethacrylate, 24 g of potassium nitrate, 6 g of sodium salt of dodecylbenzenesulfonic, a dye emulsified and dispersed product equivalent to 2 g/m$^2$ composed of 20 g of the following anti-halation dye-1 and glyoxal was prepared. On one surface of a polyethylene terephthalate base wherein a copolymer aqueous dispersed product obtained through diluting glycydyl methacrylate-methylacrylate-butylmethacrylate copolymer (50:10:40) in a manner that its density is 10 wt % was coated as a subbing solution, gelatin, a matting agent, glyoxal and a protective layer solution composed of sodium dodecylbenzene sulfonic acid was coated so that a support provided with backing was prepared.

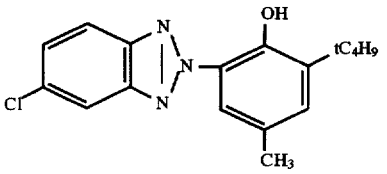

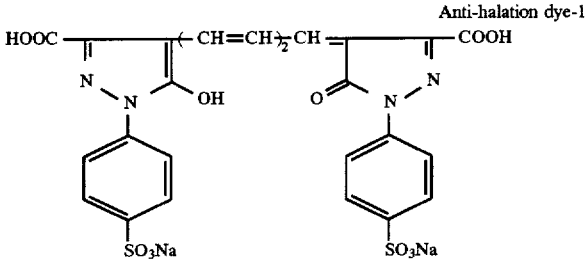

Incidentally, on the base provided with the backing layer, the above-mentioned emulsion coating solution and protective layer solution were coated concurrently by a slide hopper in a manner that the coated amount of gelatin was 2.4 g/m$^2$ and that of silver was 2.1 g/m$^2$ for obtaining a sample film.

By the use of a sample obtained in the above-mentioned manner, photographic performance was evaluated. Evaluation method was as follows.

In accordance with the following procedures (A and B), a tablet for replenishing development was prepared.

Procedure (A)

In a commercially available bandam mill, 3000 g of hydroquinone which is a developing agent was crushed until the average particle size be 10 μm. To this powder, 3000 g of sodium sulfite, 2000 g of potassium sulfite and 1000 g of dimezone S were added, and then, mixed for 30 minutes. Next, in a commercial stirring and granulating machine, 30 ml of water was added to the resulting mixture for about 10 minutes for granulating. Following this, the granulated product was dried in a fluidized bed drier at 40° C. for 2 hours so that moisture in the granulated product was removed almost completely. To the granulated product prepared in the above-mentioned manner, 100 g of polyethylene glycol (the molecular weight is 6000) was mixed uniformly by the use of a mixer in a room whose conditions were regulated to 25° C. and 40%RH or less. Following this, the resulting mixture was compressed for tableting by a tableting machine in which Tough Press Correct 1527 HU produced by Kikusui Seisakusho was modified wherein the amount of filling was 3.84 g so that 2500 tablets of tablet A for replenishing development was prepared.

Procedure (B)

In the same manner as in Procedure (A), 100 g of DTPA, 4000 g of potassium carbonate, 10 g of 5-methylbenzotriazole, 7 g of 1-phenyl-5-mercapto tetrazole, 5 g of 2-mercaptohypoxanetine, 200 g of KOH and N-acetyl-D,L-penisilamine were crushed and granulated. The added amount of water was 30.0 ml. After granulating, moisture in the granulated product was removed almost completely by drying for 30 minutes at 50° C. The mixture obtained in this manner was compressed for tableting by a tableting machine in which Tough Press Correct 1527 HU produced by Kikusui Seisakusho was modified wherein the amount of filling was 1.73 g so that 2500 tablets of tablet B for replenishing development was prepared.

Procedure (C)

In the same manner as in Procedure (A), 14000 g of ammonium thiosulfate/sodium thiosulfate (70/30 by weight ratio) and 1500 g of sodium sulfite were crushed, and then, they were mixed uniformly in a commercially available mixer. Next, in the same manner as in Procedure (A), granulating was conducted wherein added amount of water was 500 ml. After granulating, the granulated product was dried for 30 mites at 60° C. so that moisture in the granulated product was removed almost completely. In this manner, to the granulated product, 4 g of sodium N-lauroyl alanine was added. In a room whose conditions were regulated to 25° C. and 40%RH, the resulting mixture was mixed for 3 minutes. Next, the resulting mixture was compressed for tableting by a tableting machine in which Tough Press Correct 1527 HU produced by Kikusui Seisakusho was modified wherein the amount of filling was 6.202 g so that 2500 tablets of tablet C for replenishing fixing was prepared.

Procedure (D)

In the same manner as in Procedure (A), 1000 g of boric acid, 1500 g of aluminum Sulfate•18 hydrate, 3000 g of sodium hydrogen acetate (glacial acetic acid and sodium acetate were mixed in an equivalent mol and dried) and 200 g of tartaric acid were crushed and granulated. The amount of water added was 100 ml. After granulating, the granulated product was dried for 30 minutes at 50° C. so that moisture in the granulated product was removed almost completely. To the resulting mixture, 4 g of sodium N-lauroyl alanine was added. After 3 minutes, the resulting mixture was compressed for tableting by a tableting machine in which Tough Press Correct 1527 HU produced by Kikusui Seisakusho was modified wherein the amount of filling was 4.562 g so that 1250 tablets of tablet D for replenishing fixing was prepared.

| Starter for developing solution | |
|---|---|
| Glacial acetic acid | 2.98 g |
| KBr | 4.0 g |
| Water was added to make 1 l. | |

When the processing of the developing solution was started (the start of running), a solution wherein 330 ml of starter was added to 16.5 l of developing solution prepared by dissolving tablets A and B for replenishing development with a diluting water was filled in a developing tank as a starting solution for starting processing.

pH of the developing solution wherein the starter was added was 10.45.

The light-sensitive material prepared in advance was subjected to expose to light in a manner that an optical density after photographic processing be 1.0 for running. When running, a machine wherein a supplying member for a solid processing composition was provided to an automatic developing machine SRX-502 so that processing speed be 29 seconds.

During running, to the developing solution, 2 tablets of the above-mentioned A and B respectively and 76 ml of water were added per 0.62 m$^2$ of light-sensitive material. pH when each A and B agents were added to 38 ml was 10.70. To the fixing solution, 2 tablets of the above-mentioned C and 1 tablet of the above-mentioned D and 74 ml of water were added per 0.62 m$^2$ of light-sensitive material. To one processing agent respectively, water was started adding together with the addition of the processing agents. In proportion to the dissolving speed of processing agent, water was added for 10 minutes in a constant speed.

| Processing conditions | | |
|---|---|---|
| Developing | 35° C. | 8.2 sec. |
| fixing | 33° C. | 5 sec |
| washing | Room temperature | 4.5 sec |

-continued

| Processing conditions | | |
|---|---|---|
| Squeeze | | 1.6 sec |
| Drying | 40° C. | 5.7 sec |
| | Total | 29 sec. |

As a comparison, a replenishing method using XD-SR and XF-SR produced by Konica was used (76 ml of developing solution and 74 ml of fixing solution were respectively added per 0.62 $m^2$).

Evaluation method and evaluation standard

In the same manner as in Example 1, the amount of residual silver, the amount of residual fixing agent and the amount of residual developing agent of each sample after being processed were measured for evaluating bleachability, washing property and image storage stability. The results are shown as follows:

TABLE 3

| Test No. | Processing composition | Replenished amount of water ($L/m^2$) | Water-dirt water saving | Amount of residual silver | Amount of residual fixing agent | Amount of residual developing agent ($mg/m^2$) | Remarks |
|---|---|---|---|---|---|---|---|
| 3-1 | Liquid | 12 | — | 0.03 | 0.1 | 0.4 | Comp. |
| 3-2 | Liquid | 6 | — | 0.05 | 0.23 | 0.9 | Comp. |
| 3-3 | Liquid | 2.5 | — | 0.09 | 0.42 | 2 | Comp. |
| 3-4 | Liquid | 0.5 | — | 0.15 | 0.54 | 3.5 | Comp. |
| 3-5 | Tablet | 12 | — | 0.01 | 0.03 | 0.09 | Comp. |
| 3-6 | Tablet | 6 | — | 0.01 | 0.08 | 0.13 | Comp. |
| 3-7 | Tablet | 2.5 | — | 0.03 | 0.18 | 0.32 | Inv. |
| 3-8 | Tablet | 0.5 | — | 0.04 | 0.21 | 0.81 | Inv. |
| 3-9 | Tablet | 2.5 | used | 0.03 | 0.16 | 0.26 | Inv. |
| 3-10 | Tablet | 0.5 | used | 0.04 | 0.2 | 0.81 | Inv. |

As is apparent from the above-mentioned table, even when the replenished amount of water is 3 $l/m^2$ or less, the samples of the present invention show excellent bleachability. In addition, their water washing property and image storage stability are also excellent.

Example 4

(Preparation of emulsion)

A silver nitrate solution, an aqueous solution of sodium chloride and an aqueous solution of potassium bromide, a solution wherein rhodium hexachloride complex was added so as to be $8\times10^{-5}$ mol per mole of silver were added to gelatin solution concurrently while controlling flow rate. After desalting, a mono-dispersed silver bromochloride emulsion (silver bromide content of 1 mole %) containing a cubic crystal having a grain size of 0.13 μm.

This emulsion was subjected to sulfur sensitization by means of a conventional method, and then, as a stabilizer, 6-methyl-4-hydroxy-1,3,3a,7-tetrazaindene was added. Following this, the following additives were added to the resulting mixture for preparing an emulsion coating solution. Next, an emulsion intermediate coating solution M-o, an emulsion protective layer coating solution P-O, a backing layer coating solution B-O and a backing protective layer coating solution BP-O were prepared by the following compositions.

(Preparation of an emulsion coating solution)

| | |
|---|---|
| NaOH(0.5N) | regulated to pH 6.5 |
| Compound (b) | 40 $mg/m^2$ |
| Saponin (20%) | 0.5 $cc/m^2$ |
| Sodium salt of Dodecylbenzenesulfonic acid | 20 $mg/m^2$ |
| 5-methylbenzotriazole | 10 $mg/m^2$ |
| Compound (f) | 6 $mg/m^2$ |
| Polymer latex (a) | 0.5 $g/m^2$ |
| Styrene-maleic acid hydrophilic copolymer (viscosity increasing agent) | 90 $mg/m^2$ |
| Gelatin | 1.2 $g/m^2$ |
| Amount of silver | 3.5 $g/m^2$ |

(a)

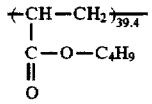

-continued

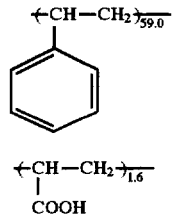

(b)

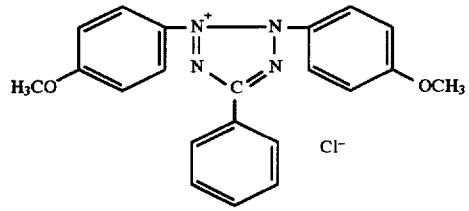

(f)

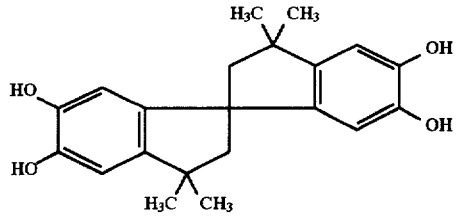

-continued (An emulsion intermediate coating solution M-O)

| | |
|---|---|
| Gelatin | 0.5 g/m² |
| Compound (g) | 10 mg/m² |
| Spherical mono-dispersed silica (grain size is 4 μ) | 8 mg/m² |
| Compound (h) | 100 mg/m² |
| Succinic acid | pH was regulated to 6.0 |
| Dye I | 120 mg/m² |

(Packing layer coating solution B-O)

| | |
|---|---|
| Gelatin | 1.5 g/m² |
| Compound (i) | 100 mg/m² |
| Compound (j) | 18 mg/m² |
| Compound (k) | 100 mg/m² |
| Saponin (20%) | 0.6 cc/m² |
| 5-nitroindazole | 20 mg/m² |
| Styrene-maleic acid hydrophilic copolymer (the above-mentioned viscosity agent) | 45 mg/m² |
| glyoxal | 4 mg/m² |
| Compound (m) | 100 mg/m² |

(Backing protective layer coating solution BP-O)

| | |
|---|---|
| Gelatin | 0.8 g/m² |
| Compound (g) | 10 mg/m² |
| Spherical polymethylmethacrylate (4 μm) | 25 mg/m² |
| Sodium chloride | 70 mg/m² |
| Glyoxal | 22 mg/m² |

(g)

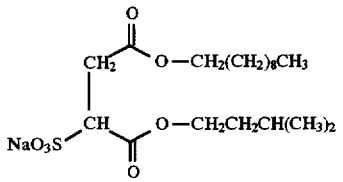

(h)

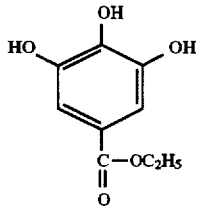

Dye I

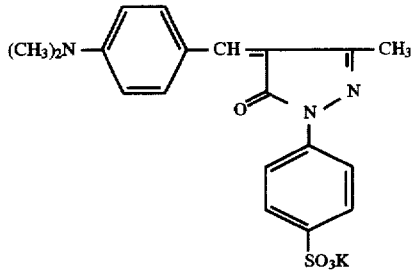

(i)

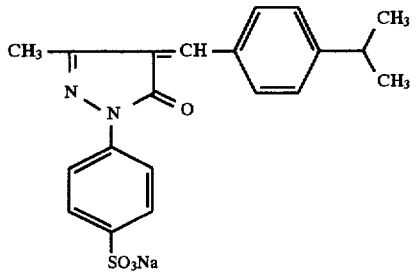

-continued (j)

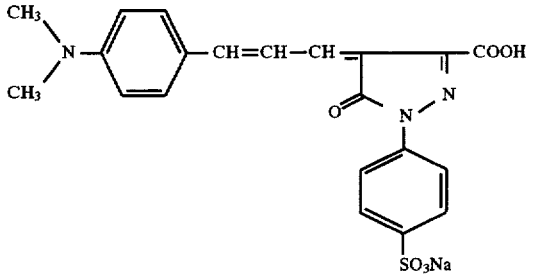

(k)

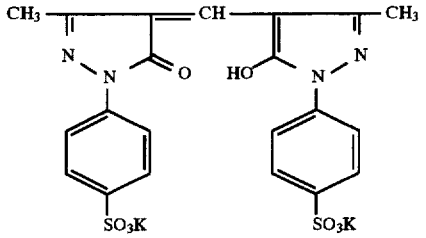

(l)

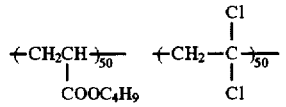

(m)

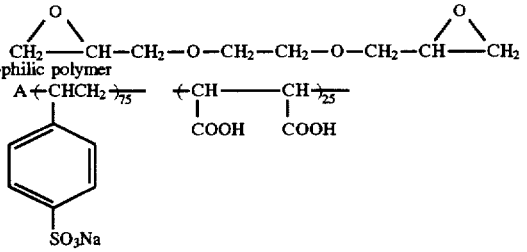

Hydrophilic polymer

Apart from above, after a polyethylene terephthalate base having a thickness of 100 μm provided with subbing described in Japanese Patent O.P.I. Publication No. 19941/1984 was subjected to corona discharge at 10 W/m²·min., the following compositions were coated by the use of a roll fit coating pan and an air knife. Drying was conducted at 90° C. for 30 minutes under a parallel flow drying condition wherein the total coefficient of heat transfer was 25 Kcal (m²·hr·°C.), and then, at 140° C. for 90 seconds. The layer thickness after being dried was 1 μm, and the specific surface resistance was $1\times10^8$ Ω at 23° C. and 55%RH.

| | |
|---|---|
| Ammonium sulfate | 0.5 g/l |
| Polyethylene oxide compound (the average molecular weight is 600) (n) | 6 g/l |
| Hardener (o) | 12 g/l |

(n)

Mixture of

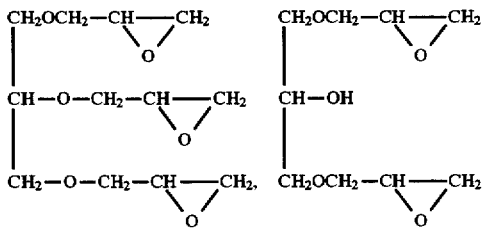

-continued and

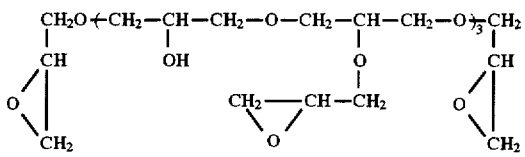

(o) 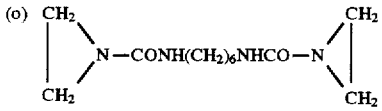

(p) $(CH_2{=}CH{-}SO_2CH_2)_4C$

On a base subjected to the above-mentioned preprocessing, first of all, as an emulsion surface side, an emulsion layer, an emulsion intermediate layer and an emulsion protective layer were coated concurrently in this order from a support by means of a slide hopper method while keeping kept at 35° C. and adding 60 mg/m$^2$ of formaldehyde which is a hardener solution. After passing a chilled air set zone (5° C.), a backing layer and a backing protective layer were coated by means of a slide hopper while adding 100 mg/m$^2$ of a hardener compound (P), and then, they were subjected to a chilled air set (5° C.). At the point when each set zone was passed, the coating solution showed sufficient setting properties. Succeedingly, both surfaces were dried simultaneously at the drying zone. Incidentally, after coating a backing surface side, the base was conveyed by a roller until winding and by a non-contact method for others. In this case, the coating speed was 100 m/min.

In this occasion, the amount of silver coated was 3.5 g/m$^2$.

(Preparation of fixing composition)

Preparation of solid fixing composition (SF-1)

4800 g of citric acid was dissolved in pure water, and 7352 g of sodium salt of citric acid (dihydrate) was dissolved in pure water. Both were made to be an aqueous solution respectively. After mixing these slowly, moisture was removed by evacuating with an aspirator while heating. The resulting solid material was crushed in a bandam mill until an average particle size becomes 10 μm to obtain powder. Next, 15811 g of anhydrous sodium thiosulfate and 500 g of anhydrous sodium sulfite were crushed in the bandam mill. After these fine powders were mixed uniformly in a commercially available mixer, 500 ml of water was added, and then, granulated by a commercially available granulating machine for 10 minutes at room temperature. This granulated product was dried for 2 hours at 40° C. in a fluidized bed dryer so that moisture in the granulated product was removed almost completely. To the granulated product prepared in the above-mentioned manner, 4 g of sodium N-lauroyl alanine was added. In a room whose conditions were controlled to be 25° C. and 40%RH or less, the mixture was mixed for 3 minutes by the use of a mixer. The resulting mixture was compressed for tableting while the amount of filling per tablet was 7.502 g by a tableting machine. The tableting machine was a modified Tough Press Correct 1527 HU produced by Kikusui Seisakusho Co., Ltd. Thus, 2000 pcs of solid fixing composition SF-1 were obtained. Next, 20 tablets were defined to be one package. Successive 20 packages were packed in one envelope by a four-side sealing style by the use of a peel-open package material formed by a polyethylene terephthalate/polyethylene/aluminum/polyethylene laminated film whose oxygen transmission ratio was 10 ml/m$^2$·24 hr·1 atm (20° C., 65%RH) and the moisture transmission rate was 2.0 g·mm/m$^2$·24 hr·1 atm. As a peel open package, Tocello CMPS011C was used as a sealant film. This film was laminated on an unoriented polypropylene film of an unoriented polypropylene film/oriented polypropylene for preparation. The prepared peel open film and the unoriented polypropylene/oriented polypropylene film were subjected to heat sealing for packaging the above-mentioned tablets.

(Preparation of developing solution)

A developing solution with the following formula was prepared.

(Formula for the developing solution SD-1)

| | |
|---|---|
| DTPA.5Na | 3.5 g |
| Sodium sulfite | 23.0 g |
| Potassium sulfite (50 wt %) | 44.0 g |
| Potassium bromide | 2.5 g |
| Aqueous solution of potassium bromide (49 wt %) | 82.0 g |
| 2-mercaptohypoxantine | 60 mg |
| Diethylene glycol | 50.0 g |
| 5-methylbenzotriazole | 0.50 g |
| Hydroquinone | 14.0 g |
| Dimezone S | 1.4 g |
| 1-phenyl-5-mercapto tetrazole | 20 mg |
| Potassium hydroxide (48.55 wt %) | 4.4 g |

Water was added to make 1 liter after regulating pH to 10.4.

(Preparation of an automatic developing machine)

GR-27 (produced by Konica) was modified to increase the line speed to one which is two times higher. In addition, on an upper lid at the upper part of a fixing tank, a hole was made so that tablet agents prepared above can be supplied to the fixing tank. In addition, in a pipe supplying washing water, a junction was prepared. The junction pipes were connected to the fixing tank through a hole through which the above-mentioned tablet agents are supplied. To this pipe, an electromagnetic valve was mounted. It was regulated so that by means of a switch 150 ml of tap water can be supplied to the fixing tank. The above-mentioned developing solution SD-1 in quantity of 60 liter was prepared by 60 liter. Among them, 40 liter was filled in the developing tank. In addition, 450 tablets of the above-mentioned solid fixing agent SF-1 were dissolved in water to make 25 liter. It was filled in the fixing tank. In addition, in the washing tank, tap water was filled. In processing a film, a flow meter was adjusted in a manner that water flows at the rate of 5 liter/minute in processing a film, and connected with the automatic developing machine.

(Evaluation)

Each of evaluation films prepared above was cut to have big sheet size of 20×24 inch. The evaluation films were processed continuously for 10 days at the rate of 20 sheets per day. The processing conditions were as follows:

TABLE 4

| | Processing time (second) | Processing temperature | Remark |
|---|---|---|---|
| Developing | 15" | 35° C. | |
| Fixing | 10" | 33 to 34° C. | The same as the temperature of the developing tank |

TABLE 4-continued

| | Processing time (second) | Processing temperature | Remark |
|---|---|---|---|
| Washing | 10" | At room temperature | |
| Drying | 10" | 48° C. | |

In this occasion, every time two big sheet films of 20×24" are processed, 3 tablets of the above-mentioned solid fixing composition SF-1 were dispensed to the fixing tank at a time. Every time, an electromagnetic valve of tap water leading to the fixing tank was turned on so that tap water was supplied by 150 ml. In addition, the amount of replenishing of developing solution was 50 ml per one sheet of 20×24".

(Comparative example)

By the use of a fixing solution having the following composition (SF-2), replenishing of the fixing solution was in liquid using condition. In this occasion, Comparative fixing solution was processed in the same manner except that the amount of replenishing was 260 ml/$m^2$. With regard to the replenishing solution for fixing solution, 50 liter was filled in a replenishing solution tank attached to an automatic developing machine GR-27. Here, the lid of the tank was closed. However, floating lid was not used on the surface of liquid.

| Comparative fixing solution formula SF-2 | |
|---|---|
| Ammonium thiosulfate (72.5 wt %) | 200 ml |
| Sodium sulfite | 20 g |
| Boric acid | 10 g |
| Sodium acetate trihydrate | 38 g |
| Aqueous solution of acetic acid (90 wt %) | 13.5 g |
| Tartaric acid | 3 g |
| Aqueous solution* of aluminum sulfate | 25 ml |

(*An aqueous solution wherein the content amount in conversion to $Al_2O_3$ is 8.1 wt %)

Water was added to make 1 liter in total after regulating pH to 4.75.

(Evaluation on residual color)

Twenty big sheet films of 20×24" size processed in advance were superposed. On a viewing box, the coloring of the films were visually checked. In the films processed by the processing method of the present invention, the coloring was not observed visually. On the contrary, on the films processed by the comparative method, slight green coloring was clearly observed.

Example 5

With the same light-sensitive material, processing agent and processing conditions as in Example 4, fixing property was evaluated by the following method. Following this, 5 big sheet of films having 20×24" size were processed continuously for 30 days, and then, fixing property was evaluated in the same manner. The following Table shows the results thereof.

<Evaluation method of fixing property>

The above-mentioned automatic processing machine was installed in a dark room. While the upper lid and rollers placed between the fixing tank and the washing tank were taken out, an unexposed 20×24" film was processed with a long side in the advancing direction. When the film came out of the fixing tank, a light was put on. While lifting it up, it was checked visually whether or not there is unfixed portion on the film (Unfixed portions are white and devitrified. At the rear edge of a film or throughout an overall film with an interval of a roller pitch, several mm to several cm streaks remain vertically to an advancing direction.). When unfixed portions were not observed, the number of seconds for development setting second is shortened. When an unfixed portion was observed, the number of development setting is lengthened. By repeating these, the minimum number of seconds for development setting second when an unfixed portion is not observed is determined. when a film is processed at this number of development setting second, a time from the edge of the film reaches the liquid surface of fixing to the rear edge of the film is taken out of the liquid surface of fixing after being conveyed in the fixing tank is defined to be a fixing time by calculating from a line speed and the path length of the fixing tank.

TABLE 5

| | Fixing time (second) | | | |
|---|---|---|---|---|
| | Initial solution | After 30 days | Remark | |
| Solid fixing composition | 5.8" | 6.3" | There is no contamination in the fixing tank. | Invention |
| Liquid fixing solution | 5.6" | 6.8" | There is coagulation of sulfur slightly. | Comparative |

In the processing method of the present invention, no contamination occurred inside the fixing tank. In addition, extension of the number of seconds for fixing after 30 days was also small. On the contrary, in the case of the comparative example, sulfur slightly coagulated which seemed to be dried in the vicinity of liquid surface inside the replenishing solution tank. In addition, extension of fixing second number after 30 days was also large.

Example 6

In the automatic processing machine (modified GR-27 machine) used in Example 4, a circulation route of the fixing solution was cut. Here, tablet dissolution tank 5 as shown in FIG. 1 was provided. To this tablet dissolution tank 5, tap water 9 supplying device (electromagnetic valve 7 and a switch not illustrated) placed at the supplying portion of a tablet was connected. By the use of this automatic processing machine, remaining color was evaluated in the same manner as in Example 4. In this occasion too, no color remaining was observed and the film after being processed was scarcely colored.

Example 7

By the use of the automatic processing machine used in Example 6, change of fixing time used for a long time was evaluated in the same manner as in Example 5. The following Table shows the results thereof.

TABLE 6

| | Fixing time (second) | | | |
|---|---|---|---|---|
| | Initial solution | After 30 days | Remark | |
| Solid fixing agent | 5.8" | 6.3" | There is no contamination in the fixing tank. | Invention |

Even when a tablet dissolving tank is provided, extension of fixing time is small in the same manner as in Example 4, and no contamination occurred.

Example 8

<Preparation of light-sensitive material>

(Preparation of light-sensitive material)

(Preparation of a support)

(Synthesis of SPS)

To 200 parts by weight of toluene, 56 g of aluminum triisobutyl and 234 g of pentamethylcyclopentadienyltitan methoxide were added. The resulting mixture was reacted at 96° C. for 8 hours. After decomposing and removing a catalyst with a methanol solution of sodium hydroxide, the mixture was washed 3 times with methanol so that 34 parts by weight of the objective compound (SPS) was obtained.

(Preparation of SPS film)

The resulting SPS was subjected to molten extrusion to be a film form from a T-die at 330° C. On a cooled drum, the resulting film was quickly cooled and solidified so that an uncentrifuged film was obtained. Here, the cooling drum was drawn at two steps. Unoriented films whose thickness was 1054 μ was heated preliminarily at 135° C. After being oriented lengthwise (3.1 times), the films were oriented transversally (3.4 times) at 130° C. In addition, the film was subjected to heat fixing at 250° C. As a result, as a support, a biaxially oriented film whose curling elasticity ratio is 450 $kg/mm^2$ and thickness is 100 μ was obtained.

(Subbing of the SPS film)

On the above-mentioned SPS film, silica was deposited. Following this, a subbing layer provided with an anti-static processing containing styrene-glycidyl acrylate and fine tin oxide particles was formed on the film.

(Preparation of silver halide emulsion A)

By the use of a double jet method, a silver bromochloride core particle having an average thickness of 0.05 μm and an average diameter of 0.15 μm composed of silver chloride in an amount of 70 mol % and silver bromide in an amount of the remaining was prepared. In mixing the core particle, $8\times10^{-8}$ mol of $K_3RuCl_6$ was added per mol of silver. To this core particle, a shell was provided by the use of the double jet method. In this occasion, $K_2IrCl_6$ was added by $3\times10^{-7}$ mol per mol of silver. The resulting emulsion was a silver bromochloroiodide tabular grain emulsion (silver chloride was 90 mol %, silver bromoiodide was 0.2 mol % and the remaining was silver bromide) having (100) plane as a main plane of a core/shell type mono-dispersed (variation coefficient is 10%) whose average thickness was 0.10 μm and average diameter was 0.25 μm. Next, by the use of denatured gelatin (illustrated compound G-8 in Japanese Patent O.P.I. Publication No. 280139/1990, on page 298(3) wherein an amino group in the gelatin was substituted with phenyl carbamoyl) described in Japanese Patent O.P.I. Publication No. 280139/1990, the emulsion was desalted. After desalting, EAg was 190 mV at 50° C.

To the resulting emulsion, 4-hydroxy-6-methyl-1,3,3a7-tetrazaindene was added by $1\times10^{-3}$ mol per mol of silver. In addition, to the mixture, potassium bromide and citric acid were added, and then, pH and EAg were respectively regulated to 5.6 and 123 mV. After adding $2\times10^{-5}$ mol of chloro aurate, $3\times10^{-6}$ mol of inorganic sulfur was added, and then, the resulting mixture was subjected to chemical ripening at 60° C. until the maximum sensitivity can be obtained. After the ripening is finished, 4-hydroxy-6-methyl-1,3,3a7-tetrazaindene was added by $2\times10^{-3}$ mol per mol of silver, 1-phenyl-5-mercapto tetrazole was added by $3\times10^{-4}$ mol and gelatin was added.

(Preparation of silver halide emulsion B)

By the use of a double jet method, a silver iodobromochloride core particle having an average thickness of 0.05 μm and an average diameter of 0.15 μm composed of 70 mol % of silver chloride, 2.5 mol % of silver iodide and the remaining of silver bromide was prepared. In mixing the core particle, $2\times10^{-8}$ mol of $K_3Rh(H_2O)Br_5$ was added per mol of silver. To this core particle, a shell was provided by the use of the double jet method. In this occasion, $K_2IrCl_6$ was added by $3\times10^{-7}$ mol per mol of silver. The resulting emulsion was a silver bromochloroiodide tabular grain emulsion (silver chloride was 90 mol %, silver bromoiodide was 0.5 mol % and the remaining was silver bromide) having (100) plane as a main plane of a core/shell type mono-dispersed (variation coefficient is 10%) whose average thickness was 0.10 μm and average diameter was 0.42 μm. Next, by the use of denatured gelatin (illustrated compound G-8 in Japanese Patent O.P.I. Publication No. 280139/1990, on page 298(3) wherein an amino group in the gelatin was substituted with phenyl carbamoyl) described in Japanese Patent O.P.I. Publication No. 280139/1990, the emulsion was desalted. After desalting, EAg was 180 mV at 50° C.

To the resulting emulsion, 4-hydroxy-6-methyl-1,3,3a7-tetrazaindene was added by $1\times10^{-3}$ mol per mol of silver. In addition, to the mixture, potassium bromide and citric acid were added, and then, pH and EAg were respectively regulated to 5.6 and 123 mV. After adding $2\times10^{-5}$ mol of chloro aurate, $3\times10^{-5}$ mol of N,N,N'-trimethyl-N'-heptafluoroseleno urea was added, and then, the resulting mixture was subjected to chemical ripening at 60° C. until the maximum sensitivity can be obtained. After the ripening is finished, 4-hydroxy-6-methyl-1,3,3a7-tetrazaindene was added by $2\times10^{-3}$ mol per mol of silver, 1-phenyl-5-mercapto tetrazole was added by $3\times10^{-4}$ mol and gelatin was added.

(Preparation of silver halide photographic light-sensitive material for printing plate scanner use for He-Ne laser light source)

On either subbing layer of the above-mentioned support, a gelatin subbing layer having the following Composition 1 for attaining the gelatin coating amount of 0.5 $g/m^2$, a silver halide emulsion layer 1 having a Composition 2 for attaining the silver coating amount of 1.5 $g/m^2$ and the gelatin coating amount of 0.5 $g/m^2$, an intermediate protective layer having the following Composition 3 for attaining the gelatin coating amount of 0.3 $g/m^2$, a silver halide emulsion layer 2 having formula 4 for attaining the silver coating amount of 1.4 $g/m^2$ and the gelatin coating amount of 0.4 $g/m^2$ and a coating solution having the following Composition 5 for attaining the gelatin coating amount of 0.6 $g/m^2$ were coated concurrently in this order from the support side. In addition, on a subbing layer on the opposite to the emulsion layers side, a backing layer having the following Composition 6 for attaining the gelatin coating amount of 0.6 $g/m^2$, a hydrophobic polymer layer having the following Composition 7 and a backing protective layer having the following Composition 8 for attaining the gelatin coating amount of 0.4 $g/m^2$ were coated concurrently with the emulsion layers side. Thus, a sample was obtained.

| | |
|---|---|
| Composition 1 (gelatin subbing layer) | |
| Gelatin | 0.5 g/m$^2$ |
| Dye AD-1 solid dispersed particle (the average particle size was 0.1 μm) | 25 mg/m$^2$ |
| Sodium polystyrene sulfonic acid | 10 mg/m$^2$ |
| S-1 (sodium-iso-amyl-n-decylsulfosuccinate) | 0.4 mg/m$^2$ |
| Composition 2 (silver halide emulsion 1) | |
| Silver halide emulsion A | Amount of silver added be 1.5 g/m$^2$ |
| Dye AD-8 solid dispersed particle (the average particle size was 0.1 μ) | 20 mg/m$^2$ |
| Cyclodextrin (hydrophilic polymer) | 0.5 g/m$^2$ |
| Sensitizing dye d-1 | 5 mg/m$^2$ |
| Sensitizing dye d-2 | 5 mg/m$^2$ |
| Hydrazine derivative H-7 | 20 mg/m$^2$ |
| Redox compound: RE-1 | 20 mg/m$^2$ |
| Compound e | 100 mg/m$^2$ |
| Latex polymer f | 0.5 g/m$^2$ |
| Hardener g | 5 mg/m$^2$ |
| S-1 | 0.7 mg/m$^2$ |
| 2-mercapto-6-hydroxyprine | 5 mg/m$^2$ |
| EDTA | 30 mg/m$^2$ |
| Colloidal silica (the average particle size was 0.05 μm) | 10 mg/m$^2$ |
| Composition 3 (an intermediate layer) | |
| Gelatin | 0.3 g/m$^2$ |
| S-1 | 2 mg/m$^2$ |
| Composition 4 (a silver halide emulsion layer 2) | |
| Silver halide emulsion B | Amount of silver be 1.4 g/m$^2$ |
| Sensitizing dye d-1 | 3 mg/m$^2$ |
| Sensitizing dye d-2 | 3 mg/m$^2$ |
| Hydrazine derivative H-20 | 20 mg/m$^2$ |
| Nuclei-production agent: exemplified compound Nb-12 | 40 mg/m$^2$ |
| Redox compound: RE-2 | 20 mg/m$^2$ |
| 2-mercapto-6-hydroxyprine | 5 mg/m$^2$ |
| EDTA | 20 mg/m$^2$ |
| Latex polymer f | 0.5 g/m$^2$ |
| S-1 | 1.7 mg/m$^2$ |
| Composition 5 (An emulsion protective layer) | |
| Gelatin | 0.6 g/m$^2$ |
| Dye AD-5 solid dispersed product (the average particle size was 0.1 μm) | 40 mg/m$^2$ |
| S-1 | 12 mg/m$^2$ |
| Matting agent: Mono-dispersed silica whose average particle size was 3.5 μm | 25 mg/m$^2$ |
| Nuclei-production accelerator: Exemplified compound Na-3 | 40 mg/m$^2$ |
| 1,3-vinylsulfonyl-2-propanol | 40 mg/m$^2$ |
| Surfactant h | 1 mg/m$^2$ |
| Colloidal silica (the average particle size was 0.05 μm) | 10 mg/m$^2$ |
| Hardener K-1 | 30 mg/m$^2$ |
| Composition 6 (backing layer) | |
| Gelatin | 0.6 g/m$^2$ |
| S-1 | 5 mg/m$^2$ |
| Latex polymer f | 0.3 g/m$^2$ |
| Colloidal silica (the average particle size was 0.05 μm) | 70 mg/m$^2$ |
| Sodium polystyrene sulfonic acid | 20 mg/m$^2$ |
| Compound i | 100 mg/m$^2$ |
| Composition 7 (hydrophobic polymer) | |
| Latex (Methylmethacrylate/acrylic acid = 97:3) | 1.0 g/m$^2$ |
| Hardener g | 6 mg/m$^2$ |
| Composition 8 (Backing protective layer) | |
| Gelatin | 0.4 g/m$^2$ |
| Matting agent: Mono-dispersed polymethylmethacrylate whose average particle size was 5 μm | 50 mg/m$^2$ |
| Sodium-di-(2-ethylhexyl)-sulfosuccinate | 10 mg/m$^2$ |
| Surfactant h | 1 mg/m$^2$ |
| Dye k | 20 mg/m$^2$ |
| $H-(OCH_2CH_2)_{68}-OH$ | 50 mg/m$^2$ |
| Hardener: K-1 | 20 mg/m$^2$ |
| Compound i | |

-continued
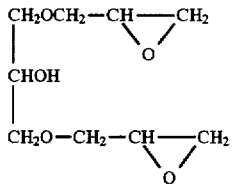
Dye k
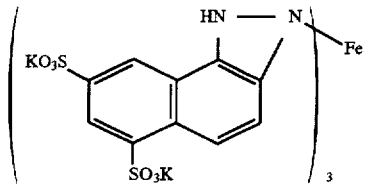
RE-1
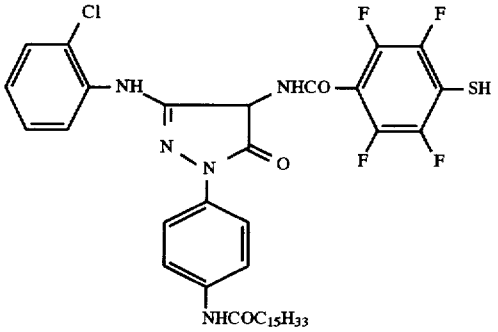
RE-2
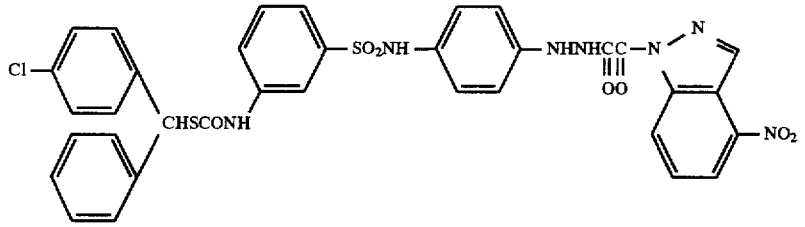
K-1
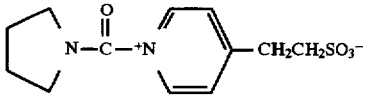
Sensitizing dye d-1
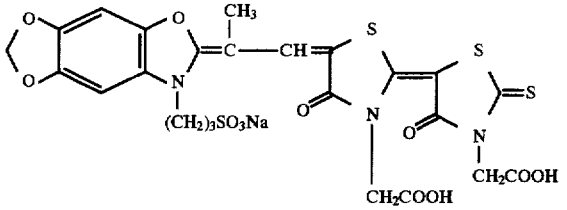
Sensitizing dye d-2
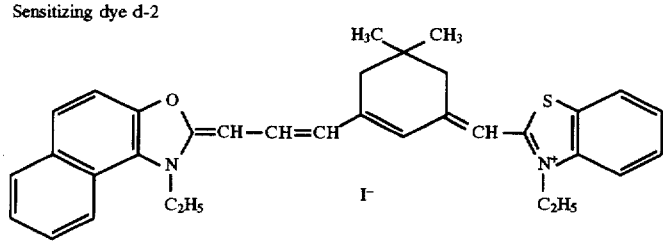

-continued
Compound e
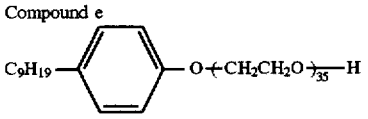
Latex polymer f
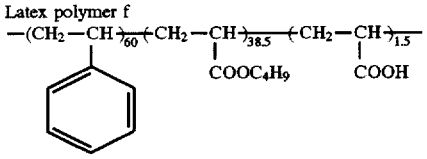
Hardener G
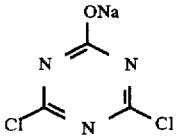
Surfactant h
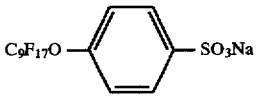
AD-1
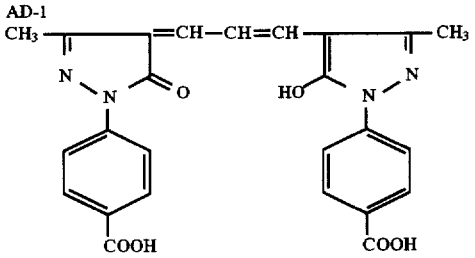
AD-5
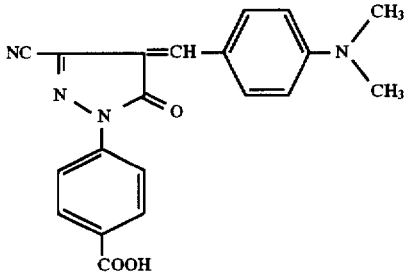
AD-8
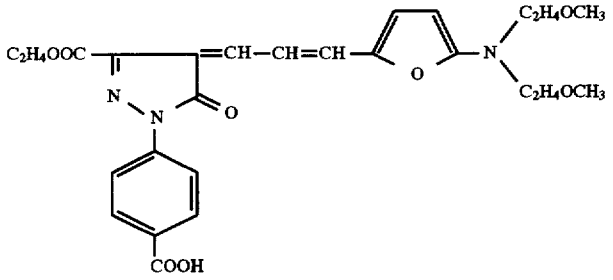

<Composition of processing solution>

<A starter for developing solution (HAD-S)>

| | |
|---|---|
| Pure water | 400 ml |
| DTPA5.Na | 1.45 g |
| Sodium sulfite | 31.52 g |
| Potassium carbonate | 155 g |
| 8-mercaptoadenine | 0.06 g |
| Diethyleneglycol | 50 g |
| 5-methylbenztriazole | 0.27 g |
| 1-phenyl-5-mercaptotetrazole | 0.03 g |
| Dimezone S | 1.1 g |
| Sodium erythrobate | 38 g |
| Diethylaminopropanediol | 25 g |
| Isoelite P (produced by Ensuikou Seitoh Company) | |

To the above-mentioned compounds, pure water and an aqueous solution of 55% potassium hydroxide are added, so that a condensed solution of 500 ml (pH was 10.45) was obtained. Further, 500 ml of pure water and 500 ml of the above-mentioned condensed solution were mixed to be make a volume of 1 liter (pH was 10.4).

<Preparation of tablet for replenishing developing (HAD-JR)>

<Preparation of granulated product part A (for 1 liter solution)>

| | |
|---|---|
| DTPA.5Na | 1.45 g |
| Sodium bisulfite | 31.52 g |
| 8-mercapto adenine | 0.06 g |
| 5-methylbenzotriazole | 0.27 g |
| Dimezone-S | 0.03 g |
| Sodium erythrobate | 38 g |
| Pine Flow (produced by Matsutani Chemical Co., Ltd.) | 4 g |

The above-mentioned material was mixed in a bandam mill for 30 minutes and the resulting mixture was granulated for 10 minutes at room temperature by a commercially available stirring type granulating machine. Following this, the granulated material was dried in a fluidized bed dryer at 40° C. for 2 hours so that granulated product A part was obtained.

| <Preparation of granulated product B part (for 1 liter solution)> | |
|---|---|
| Potassium carbonate | 155 g |
| D-mannitol (produced by Kao) | 5 g |
| Lithium hydroxide | 3 g |

The above-mentioned material was mixed in a bandam mill for 30 minutes and the resulting mixture was granulated for 10 minutes at room temperature by a commercially available granulating machine of a stirring type. Following this, the granulated material was dried in a fluidized bed dryer at 40° C. for 2 hours so that granulated product B part was obtained.

The above-mentioned A part and B part were mixed for 10 minutes, and the resulting mixture was compressed and tableted under 1.5 ton/$m^2$ by applying compression by making use of a tableting machine, Machina UD•DFE30•40 produced by Machina Co., Ltd. wherein a filling amount per tablet was as shown in Table 1, so that 25 tablets having a diameter of 30 mm and a thickness of 10 mm were obtained.

Incidentally, for an initial solution inside the automatic processing machine, 1000 tablets were dissolved in 40 l of water to be used.

| Comparative development replenishing solution (HAD-SR)) | |
|---|---|
| For 1 liter solution | |
| Pure water | 400 ml |
| DTPA.5Na | 1.45 g |
| Sodium sulfite | 31.52 g |
| Potassium carbonate | 155 g |
| 8-mercapto adenine | 0.06 g |
| 5-methylbenzotriazole | 0.27 g |
| 1-phenyl-5-mercaptotetrazole | 0.03 g |
| Dimezone-S | 1.1 g |
| Sodium erythrobate | 38 g |
| Pine Flow (produced by Matsutani Chemical) | 4 g |
| D-mannitol (produced by Kao) | 5 g |
| Lithium hydroxide | 3 g |

To the above-mentioned compounds, pure water was added, so that 500 ml of a condensed solution was obtained (pH was 10.45). When using, 500 ml of pure water and 500 ml of the above-mentioned condensed solution were mixed to be used. The pH of the resulted replenishing solution was 10.4.

| <A starter for a fixing solution (HAF-S)> | |
|---|---|
| For 1 liter solution | |
| Pure water | 120 ml |
| Sodium thiosulfate | 155 g |
| Sodium sulfite | 22 g |
| Boric acid | 10 g |
| Tartaric acid | 3 g |
| Sodium acetate trihydrate | 37.8 g |
| Citric acid | 35 g |
| Aluminum sulfate 18-hydrate | 18 g |
| Isoelite-P (Produced by Ensuiko Seitou) | 5 g |

To the above-mentioned compounds, 50% aqueous solution of sulfuric acid and pure water were added, so that 500 ml of a condensed solution was obtained (pH was 4.83). When using, 500 ml of pure water and 500 ml of the condensed solution were mixed to be make a volume of 1 liter.

| <Preparation of tablet used for replenishing fixing> | |
|---|---|
| Preparation of granulated product part A (for 1 liter solution) | |
| Sodium thiosulfate | 155 g |
| Sodium bisulfite | 10 g |
| Sodium acetate | 40 g |
| Isoelite P (produced by Ensuikouseitoh) | 5 g |
| Pine Flow (produced by Matsutani Chemical) | 8 g |

The above-mentioned materials were mixed in a commercially available bandam mill for 30 minutes. In addition, the resulting mixture was granulated in a commercially available granulating machine of a stirring type for 10 minutes for granulating. Following this, the granulated product was dried in a fluidized bed drier at 40° C. for 2 hours so that a granulated product part A was obtained.

| Preparation of granulated product part B | |
|---|---|
| Boric acid | 10 g |
| Tartaric acid | 3 g |
| Sodium hydrogen sulfate | 18 g |

-continued

| Preparation of granulated product part B | |
|---|---|
| Aluminum sulfate.18 hydrate | 37 g |
| Pine Flow (the product name: Matsutani Chemical) | 4 g |

The above-mentioned materials were mixed in a commercially available bandam mill for 30 minutes. In addition, the resulting mixture was granulated in a commercially available granulating machine of a stirring for 10 minutes for granulating. Following this, the granulated product was dried in a fluidized bed drier at 40° C. for 2 hours so that a granulated product part B was obtained.

The above-mentioned part A and part B were mixed completely for 10 minutes, and the resulting mixture was compressed and tableted under 1.5 ton/m$^2$ by making use of a tableting machine Machina UD•DFE30•40 produced by Machina Co., Ltd. wherein a filling amount per tablet was as shown in Table 1, so that 25 tablets having a diameter of 30 mm and a thickness of 10 mm were obtained.

Incidentally, for an initial solution inside the automatic processing machine, 500 tablets were dissolved in 20 l of water to be used.

| <Comparative fixing replenishing solution> | |
|---|---|
| For 1 liter solution | |
| Pure water | 250 ml |
| Sodium thiosulfate | 155 g |
| Sodium bisulfite | 16 g |
| Boric acid | 10 g |
| Tartaric acid | 3 g |
| Sodium acetate | 40 g |
| Sodium hydrogen sulfate | 18 g |
| Aluminum sulfate.18 hydrate | 37 g |
| Isoelite P (Ensuikouseitoh) | 5 g |
| Pine Flow (produced by Matsutani Chemical) | 4 g |

To the above-mentioned compounds, pure water was added, so that 500 ml of a condensed solution was obtained (pH was 4.05). When using, 500 ml of pure water and 500 ml of the above-mentioned condensed solution were mixed to be used (pH was 4.10).

<Automatic processing machine>

Figure 2:
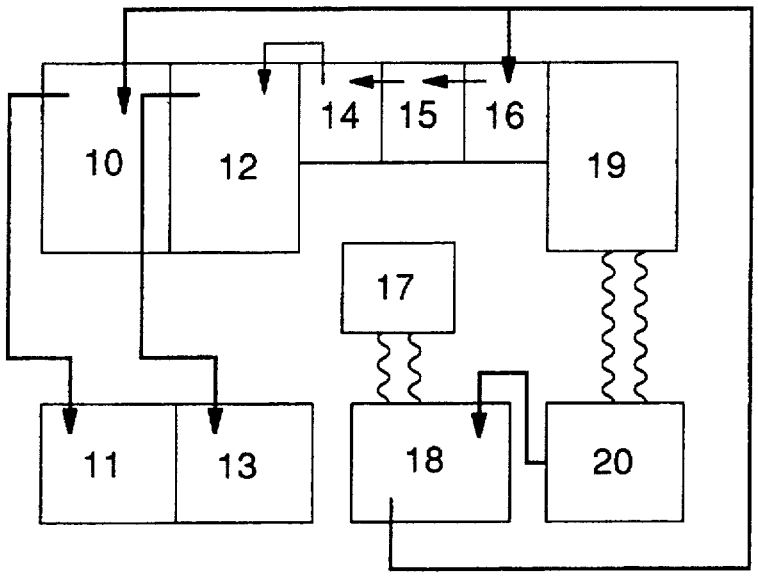
FIG. 2 is a schematic view of a cascaded counter-current washing type (3-steps) automatic processing machine.

The washing section of GR-26 produced by Konica was modified to a three-step counter-current washing type as shown in the FIG. 2. In the case of replenishing a replenishing solution, 40 ml of a developer and 40 ml of a fixer were replenished per one big sheet of light-sensitive material (610×508 mm). When a tablet is directly dispensed, the machine was modified in a manner that the tablet can be dispensed from the upper part of the automatic processing machine one tablet by one. Per one big sheet of light-sensitive material (610× 508 mm), one tablet used for development replenishing and 40 ml of water, one tablet used for fixing replenishing and 40 ml of water were added respectively.

The replenishing amount of water was as shown in the following table 7.

| <Processing conditions> | | |
|---|---|---|
| | Temperature | Time |
| Developing | 35° C. | 30 sec. |
| Fixing | 34° C. | 20 sec. |
| Washing | at room temperature | 20 sec. |
| Drying | 45° C. | 20 sec. |
| Line speed (conveyance speed): 984 mm/min. | | |

After the above-mentioned light-sensitive materials were exposed in a manner that a blackening rate be 50%, 200 sheets of 508×610 mm size of light-sensitive material were processed 4 days respectively. After processing, one 508×610 mm size was processed and evaluated in the same manner as in Example 1.

TABLE 7

| No. | Replenishing composition Developing | Fixing | Replenished amount of water (L/m$^2$) | Amount of residual silver | Amount of residual of fixing agent | Amount of residual developing agent (mg/m$^2$) | Yellow stain of processed film | Remarks |
|---|---|---|---|---|---|---|---|---|
| 1 | Liquid composition | Liquid composition | 5 | 0.01 | 0.10 | 0.4 | 5 | Comparative |
| 2 | Liquid composition | Liquid composition | 0.2 | 0.03 | 0.53 | 3.2 | 3 | Comparative |
| 3 | Liquid composition | Solid composition | 5 | 0.01 | 0.03 | 0.05 | 5 | Comparative |
| 4 | Liquid composition | Solid composition | 2.5 | 0.01 | 0.04 | 0.06 | 7 | Inventive |
| 5 | Liquid composition | Solid composition | 0.2 | 0.01 | 0.04 | 0.06 | 8 | Inventive |
| 6 | Liquid composition | Solid composition | 0.05 | 0.02 | 0.06 | 0.08 | 7 | Inventive |
| 7 | Solid composition | Liquid composition | 5 | 0.01 | 0.04 | 0.05 | 5 | Comparative |
| 8 | Solid composition | Liquid composition | 2.5 | 0.01 | 0.04 | 0.06 | 7 | Inventive |
| 9 | Solid composition | Liquid composition | 0.2 | 0.01 | 0.04 | 0.07 | 8 | Inventive |
| 10 | Solid | Liquid | 0.05 | 0.02 | 0.06 | 0.08 | 7 | Inventive |

TABLE 7-continued

| No. | Replenishing composition: Developing composition | Replenishing composition: Fixing composition | Replenished amount of water ($L/m^2$) | Amount of residual silver | Amount of residual of fixing agent | Amount of residual developing agent ($mg/m^2$) | Yellow stain of processed film | Remarks |
|---|---|---|---|---|---|---|---|---|
| 11 | Solid composition | Solid composition | 5 | 0.01 | 0.04 | 0.05 | 5 | Comparative |
| 12 | Solid composition | Solid composition | 2.5 | 0.01 | 0.04 | 0.06 | 9 | Inventive |
| 13 | Solid composition | Solid composition | 0.2 | 0.01 | 0.05 | 0.06 | 10 | Inventive |
| 14 | Solid composition | Solid composition | 0.05 | 0.01 | 0.05 | 0.06 | 9 | Inventive |

What is claimed is:

1. A method for processing an exposed black and white silver halide photographic light-sensitive material comprising:

(1) developing said exposed black and white silver halide photographic light-sensitive material with a developing solution, (2) fixing the developed material with a fixing solution, (3) washing the fixed material with water which is replenished in an amount of from 0 to 3 liter/$m^2$ of said exposed black and white silver halide photographic light-sensitive material, (4) drying the washed material, and (5) replenishing a solid photographic composition into said developing solution, wherein said solid photographic composition replenished into said developing solution comprises a developing agent selected from the group consisting of a dihydroxybenzene developing agent represented by Formula I and a developing agent represented by Formula II, provided that said developing agent represented by Formula II may form a sodium salt, a potassium salt or a lithium salt, wherein Formula I and Formula II are as follows:

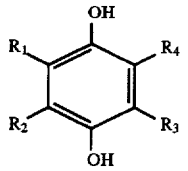

Formula I wherein $R_1$, $R_2$, $R_3$, and $R_4$ each represents a hydrogen atom, an alkyl group, an aryl group, a carboxyl group, a halogen atom or a sulfo group; and

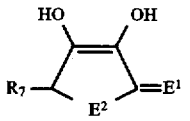

Formula II wherein $R_7$ represents a hydrogen atom, an alkyl group, an aryl group, an amino group, an alkoxy group, a sulfo group, a carboxyl group, an amido group or a sulfonamido group; $E^1$ represents an oxygen atom or a sulfur atom; $E^2$ represents an oxygen atom, a sulfur atom or an $NR_8$ group, provided that $R_8$ represents an alkyl group or an aryl group.

2. The method of claim 1, wherein said developing agent is a hydroquinone.

3. The method of claim 1, wherein said developing agent is a compound selected from the group consisting of L-ascorbic acid, D-ascorbic acid, L-erythrobic acid, D-glucoascorbic acid, L-erythroascorbic acid, 6-deoxy-L-ascorbic acid, L-rhamnoascorbic acid, D-glucoheptoascorbic acid, imino-6-deoxy-L-ascorbic acid, imino-D-glucoheptoascorbic acid, L-glycoascorbic acid, D-galactoascorbic acid, L-araboascorbic acid and sorboascorbic acid.

4. The method of claim 1, wherein said fixing solution includes a fixing agent which is a thiosulfate compound selected from the group consisting of sodium thiosulfate, potassium thiosulfate and lithium thiosulfate.

5. The method of claim 1, wherein said fixing solution is replenished with a composition which includes a buffer agent selected from the group consisting of tartaric acid, citric acid, malic acid, maleic acid, itaconic acid, adipic acid, 3'-3-thiodipropionic acid, propionic acid, levulinic acid, phthalic acid, malonic acid, glutaric acid, lactic acid, boric acid, and succinic acid.

6. The method of claim 1, wherein said fixing solution is replenished with a composition which includes a buffer agent selected from the group consisting of citric acid, itaconic acid, succinic acid and tartaric acid.

7. The method of claim 1, wherein said water is replenished in an amount of from 60 ml to 240 ml/$m^2$ of said exposed silver halide photographic light-sensitive material in the washing step.

8. The method of claim 1, wherein said solid photographic composition is a tablet having a bulk density of 1.0 to 2.5 g/$cm^3$.

9. The method of claim 1, wherein said solid photographic composition is a granule or a powder each having a bulk density of 0.40 to 0.95 g/$cm^3$.

10. The method of claim 1, wherein said solid photographic composition used for said developing solution comprises a developing agent represented by Formula II, provided that said developing agent may form a sodium salt or a lithium salt.

11. The method of claim 1, wherein said fixing solution is replenished with a solid photographic composition including a fixing agent.

* * * * *